US011066210B1

(12) United States Patent
Ankele et al.

(10) Patent No.: US 11,066,210 B1
(45) Date of Patent: Jul. 20, 2021

(54) NYLON PALLET

(71) Applicants: David Ankele, Santa Clara, CA (US); Dale Woiken, Upland, CA (US)

(72) Inventors: David Ankele, Santa Clara, CA (US); Dale Woiken, Upland, CA (US)

(73) Assignee: David Ankele, San Mateo, CA (US)

( * ) Notice: Subject to any disclaimer, the term of this patent is extended or adjusted under 35 U.S.C. 154(b) by 0 days.

(21) Appl. No.: 16/948,073

(22) Filed: Sep. 1, 2020

(51) Int. Cl.
*B65D 19/00* (2006.01)

(52) U.S. Cl.
CPC ..... *B65D 19/0036* (2013.01); *B65D 2519/00034* (2013.01); *B65D 2519/00069* (2013.01); *B65D 2519/00139* (2013.01); *B65D 2519/00273* (2013.01); *B65D 2519/00288* (2013.01); *B65D 2519/00318* (2013.01); *B65D 2519/00567* (2013.01); *B65D 2519/00741* (2013.01)

(58) Field of Classification Search
CPC ..... B65D 2519/00034; B65D 2519/00273; B65D 2519/00288; B65D 2519/00318; B65D 2519/00567; B65D 2519/00741
USPC ..... 108/56.3, 56.1, 57.25
See application file for complete search history.

(56) References Cited

U.S. PATENT DOCUMENTS 3,664,271 A 5/1972 Wolder et al.
3,667,403 A 6/1972 Angelbeck
3,824,933 A 7/1974 Lind
4,597,338 A 7/1986 Kreeger
5,582,113 A 12/1996 Langenbeck
5,809,905 A * 9/1998 John ..... B65D 19/0018 108/56.1
6,029,583 A * 2/2000 LeTrudet ..... B65D 19/0012 108/57.25
6,109,190 A * 8/2000 Hale ..... B65D 19/0016 108/57.25
6,622,641 B2 * 9/2003 Smyers ..... B65D 19/0012 108/56.1
6,805,061 B2 10/2004 Smyers et al.
6,814,287 B1 * 11/2004 Chang ..... B65D 19/38 235/451
6,938,558 B1 * 9/2005 Peres ..... B65D 19/0095 108/56.3
6,976,436 B1 * 12/2005 Sugihara ..... B65D 19/0018 108/57.25
7,308,857 B2 12/2007 Moore et al.
(Continued)

FOREIGN PATENT DOCUMENTS

EP 2615041 A1 * 7/2013 ..... B65D 19/12
EP 2628686 A1 8/2013
(Continued)

*Primary Examiner* — Jose V Chen
(74) *Attorney, Agent, or Firm* — Charles L. Thoeming

(57) ABSTRACT

Nylon pallets constructed from injection molded top and bottom portions having mirror image upstanding post open ends and upstanding posts with extended attachment clips configured in corresponding arrays on opposing top and bottom surfaces, with each open end and attachment clip pairing when connected locked together by a locking pin. Each pallet provides real time tracking, identification, and monitoring capabilities from at least one removable communication/sensor box releasably secured between conjoined top and bottom portions. Each pallet provides equipment entry passages between top and bottom portions from all four pallet sides.

10 Claims, 22 Drawing Sheets

(56) References Cited

U.S. PATENT DOCUMENTS 7,490,561 B1 * 2/2009 Chou ..... B65D 19/0095 108/56.1
7,748,329 B2 * 7/2010 Baltz ..... B65D 19/0048 108/56.1
8,950,342 B2 * 2/2015 Plattner ..... B65D 19/0016 108/56.3
9,352,876 B2 5/2016 Muirhead
10,339,619 B2 * 7/2019 Muirhead ..... G06Q 30/0185
10,846,648 B2 * 11/2020 Jones ..... G06Q 10/0833
2005/0076816 A1 * 4/2005 Nakano ..... B65D 19/0012 108/51.11
2005/0241548 A1 * 11/2005 Muirhead ..... B29C 66/9672 108/51.3
2006/0212165 A1 * 9/2006 Watanabe ..... B65D 19/38 700/217
2008/0115699 A1 * 5/2008 Miller ..... B65D 19/0095 108/56.1
2010/0176076 A1 * 7/2010 Kern ..... G06Q 10/087 211/60.1
2010/0182150 A1 7/2010 Edelstain
2013/0160680 A1 * 6/2013 Ten Bok ..... B29C 44/0407 108/50.11
2013/0274387 A1 * 10/2013 Zwick ..... C08L 23/06 524/94
2014/0102338 A1 * 4/2014 Stevens ..... B65D 19/0095 108/50.11
2014/0283714 A1 * 9/2014 Wahl ..... B65D 19/0014 108/51.11
2015/0274359 A1 * 10/2015 Linares ..... B65D 19/38 108/53.1
2019/0031394 A1 * 1/2019 Millhouse ..... B62B 5/0093
2019/0034863 A1 * 1/2019 Winkle ..... B65D 19/38
2019/0168912 A1 * 6/2019 de Bokx ..... B65D 19/0016
2020/0062449 A1 * 2/2020 Marovac ..... B60L 53/80
2020/0216219 A1 * 7/2020 Shawaf ..... B65D 19/0016

FOREIGN PATENT DOCUMENTS

WO 2015004601 A1 1/2015
WO 2018236207 A1 12/2018

* cited by examiner

NYLON PALLET

The invention relates to trackable pallets made of nylon, and useful methods for their preparation and use.

BACKGROUND

Transport and storage containers made of plastic are widely used in national and international trade. These containers protect and carry their contents during storage and transport, and there is a growing need for durable containers that efficiently maintain the quality of their contents.

One especially useful transport and storage containers is the pallet, a structural platform made of metal, wood, or plastic materials. Wooden pallets have been around for several years used, but their production and maintenance make them unwieldy and expensive. In addition, wooden pallets have limited useful life due to adverse weather and can fail due to rotting when they are wet. In addition, wooden pallets are assembled by fastener means such as glue, nails, or staples. Harsh weather conditions also accelerate the decline of these fasteners leading to failure of the wooden pallets.

The potential for insect infestation also presents a growing need to treat wooden pallets created before export. For nearly twenty years, the European Union has required heat treatment or chemical treatment for all unprocessed wood pallets made from conifers. Freight transport on wooden pallets that do not meet these requirements are rejected at the border. It is even more likely is that such non-compliant wooden pallets are destroyed at the expense of the shipper.

Metal pallets also have problems. Typically, they are expensive, heavy, and susceptible to corrosion.

Plastic pallets, including High-density Polyethylene ("HDPE"), present possible flammability issues and related problems. If fire occurs, plastic pallets are susceptible to flow, resulting in molten plastic leads, whereby the heat and fire spreads. The National Fire Protection Association has issued Forced Regulations that the usefulness of plastic pallets to reduce these hazards. These Regulations impose that plastic pallets have a composition comprising a thermosetting resin, which may be an epoxy resin, and a plurality of thermoplastic resins. These compositions may contain, for example, flame retardants. One known approach is constructions of polyvinylchloride pallets having a polyolefin upper deck and a polycarbonate or polyphenylene lower deck. Other approaches employ a polyolefin/halogenated epoxy pallet composition, where the halogenated epoxide acts as a flame retardant, optionally combined with a second flame retardant. These retardant regulations impose the expense of one or more of these additional and complex manufacturing component chemical subparts.

Another limitation for goods stored and transported on pallets internationally are that the specific goods are not trackable, monitored, or accounted for between a shipping port and a receiving port of entry.

Finally, a further limitation for goods stored and transported on pallets internationally are that during transport or storage the specific goods are subjected to extreme environmental conditions that degrade or spoil the transported goods with no means for alerting the sending party, the transporting party, or the receiving party of these conditions during storage and transport.

Thus there is a need for an improved pallet constructed of nylon that is durable and that overcomes the many limitations of existing metal, wood, and plastic pallets.

There is yet a further need for an improved pallet construction of nylon that provides a low profile, high weight capacity with pallet jack, forklift, and pallet equipment (PE) access from all sides through openings within the pallet so the improved pallet can be used with most material handling equipment including forklifts, pallet jacks, PE, and palletizers and other standard material handling equipment used in the art.

There is a further need for an improved pallet constructed of nylon rated to have a "no flashpoint" rating by either Underwriting Laboratories or nylon manufacturers making nylon a natural fire-resistant material eliminating any need for fire retardants. Constant re-evaluation of carcinogens in fire retardant means for plastic pallets under the Environment Protection Act make plastic pallets potential targets for recalls for the fire-retardant chemicals. The improved nylon pallet overcomes this limitation of plastic pallets and makes the improved nylon pallets especially suited for the food and pharmaceutical industries.

A further need for an improved pallet constructed of nylon is using only recycled nylon for the improved nylon pallet manufacture, thus greatly decreasing the environmental carbon footprint of such durable improved pallets. The nylon pallets would also be recyclable into new nylon pallets at the end of each improved nylon pallet's useful life cycle.

There is yet a further need for an improved nylon pallet that includes data collecting capabilities using RFID/GPS hybrid cellular based tags and/or sensors for temperature and environmental gasses such as carbon dioxide for data transmission during storage and transport, and use of other block-chain technologies, to maximize pallet platform and data potential, to meet the needs of shippers, transporters, and recipients, and to fulfil governmental regulations and industry standards.

A further need exists for an improved nylon pallet capable of accepting custom designed removable locking casters providing more flexibility where forklifts, pallet jacks, or PE cannot access or move pallets in tight spaces. This feature allows pallet interlinking to enhance forklift utility in pulling multiple loads at a time saving forklift trips. Locking casters also allow movement of heavily loaded pallets on a warehouse floor without the need of forklifts, pallet jacks, or PE.

DISCLOSURE OF INVENTION

A trackable nylon pallet provides a rigid, injection molded nylon bottom portion having a planar bottom side and a top side, two equal length sides, two equal width sides, and four ninety-degree corners. A plurality of equal sized upstanding nylon posts is affixed to the bottom portion top side in arrays of upstanding nylon posts with extended nylon attachment clips and upstanding nylon posts with an open end sized to receive the extended nylon attachment clip.

The trackable nylon pallet also provides a rigid, injection molded nylon top portion of equal size to the bottom portion and comprising a bottom side and a planar top side, two equal length sides, two equal width sides, four ninety-degree corners. A plurality of equal sized upstanding nylon posts is affixed to the top portion bottom side in arrays of upstanding nylon posts with extended nylon attachment clips and upstanding nylon posts with an open end sized to receive the extended nylon attachment clip.

Each trackable pallet includes a nylon locking pin to secure each upstanding nylon post with extended attachment clip to each upstanding nylon post open end.

Each trackable pallet includes an interchangeable communications/sensor box providing an integral global positioning system, at least one integral radio frequency identification device, at least one integral temperature sensor, at least one integral sensor calibrated to detect chemicals, an integral power supply and connected wiring to power components housed in the communications/sensor box.

Each trackable nylon pallet includes at least one integral frame sized to receive and hold the interchangeable communications box without the necessity of opening or otherwise breaking down the nylon pallet.

Each trackable nylon pallet bottom portion planar bottom side is adaptable to receive and be affixed to four removeable, locking casters, one such caster in each of the four ninety-degree corners.

Each trackable nylon pallet provides a low profile, high weight capacity with pallet jack, forklift, and pallet equipment (PE) access from all sides through openings within the pallet so the improved pallet can be used with most material handling equipment including forklifts, pallet jacks, PE, and palletizers and other standard material handling equipment used in the art.

Embodiments of the trackable nylon pallet provide an equal sized rectangular molded nylon top and nylon bottom portions.

Embodiments of the trackable nylon pallet provide equal sized square molded nylon top and nylon bottom portions.

Each trackable nylon pallet can withstand a rack able load of 2,722 kg, and a static load of 45,359 kg.

BRIEF DESCRIPTION OF DRAWINGS

These and other features, aspects, and advantages of the trackable nylon pallets will become better understood regarding the following description, and drawings as further described.

//

//

BEST MODE FOR CARRYING OUT THE INVENTION

Embodiments of the nylon pallet 100, 200, 300 and 400 provide a rigid, injection molded nylon bottom portion 102, 202, 302, and 402, respectively, including a bottom portion planar bottom side 106, 206, 306, and 406, respectively, and a bottom portion top side, 108, 208, 308, and 408, respectively, FIGS. 1-20.

Embodiments of the nylon pallet bottom portion 102, 202, 302, and 402 include two equal pallet length sides, 114, 214, 314, and 414, respectively, two equal pallet width sides, 116, 216, 316, and 416, respectively, and four ninety-degree corners, 118, 218, 318, and 418, respectively, FIGS. 1-5, 8-19.

Figure 13:
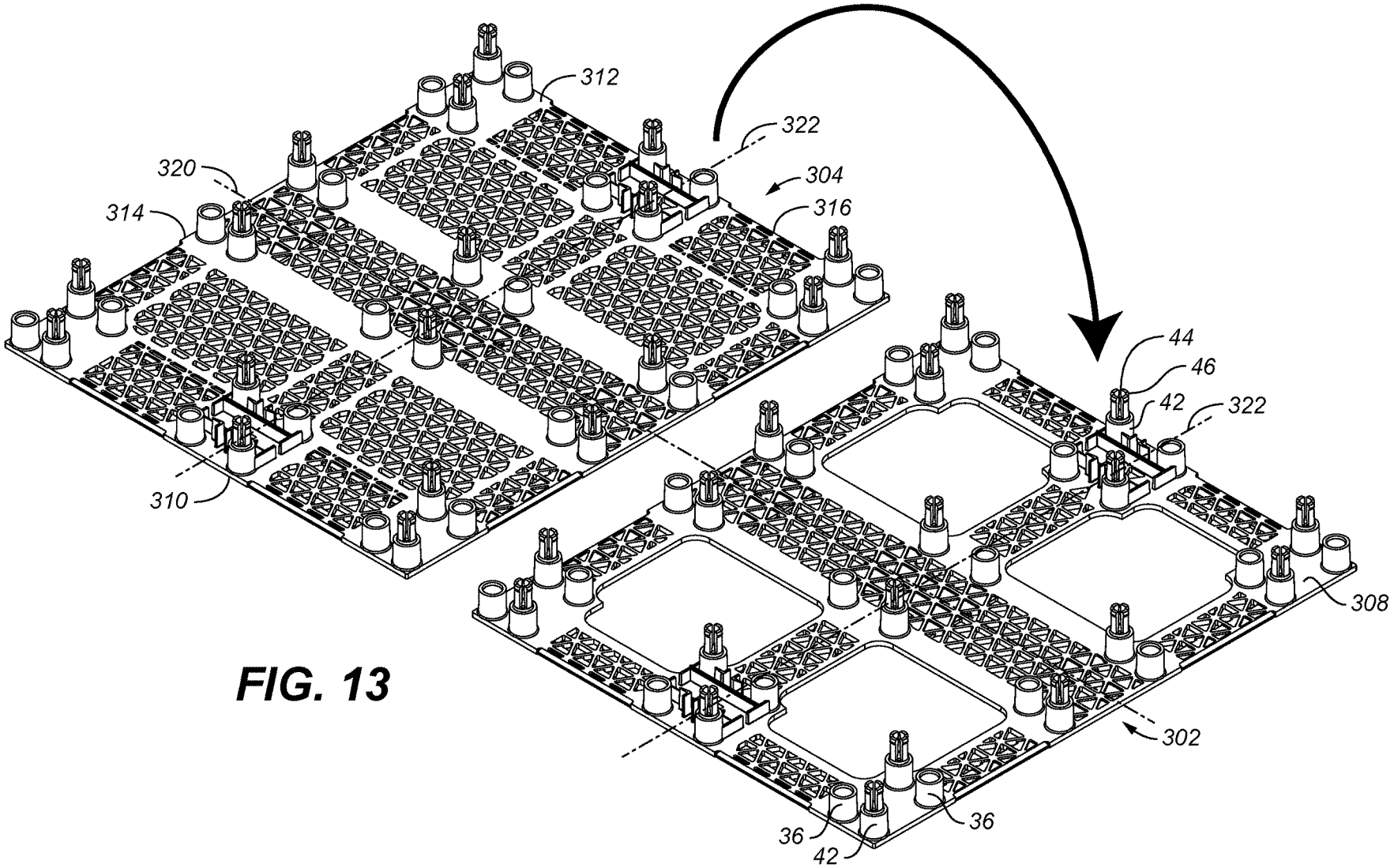
FIG. 13 depicts top right perspective views of the top portion 304 and bottom potion 302 of the trackable nylon pallet of FIG. 12 before the top and bottom portions are connected.
Figure 14:
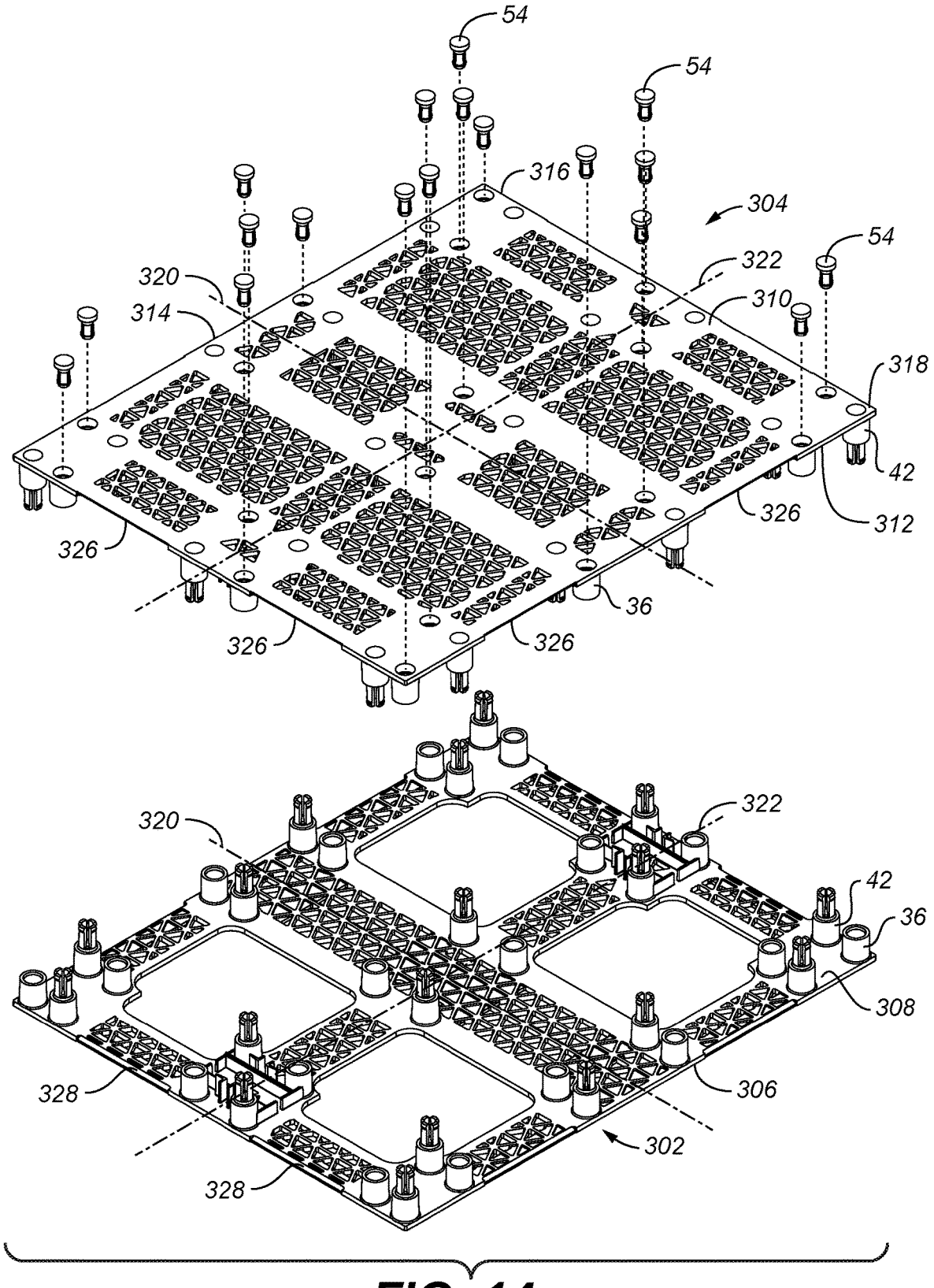
FIG. 14 depicts top right perspective views of the alignment of top portion 304 and bottom potion 302 of the trackable nylon pallet of FIG. 12 before the top and bottom portions are connected.
Figure 15:
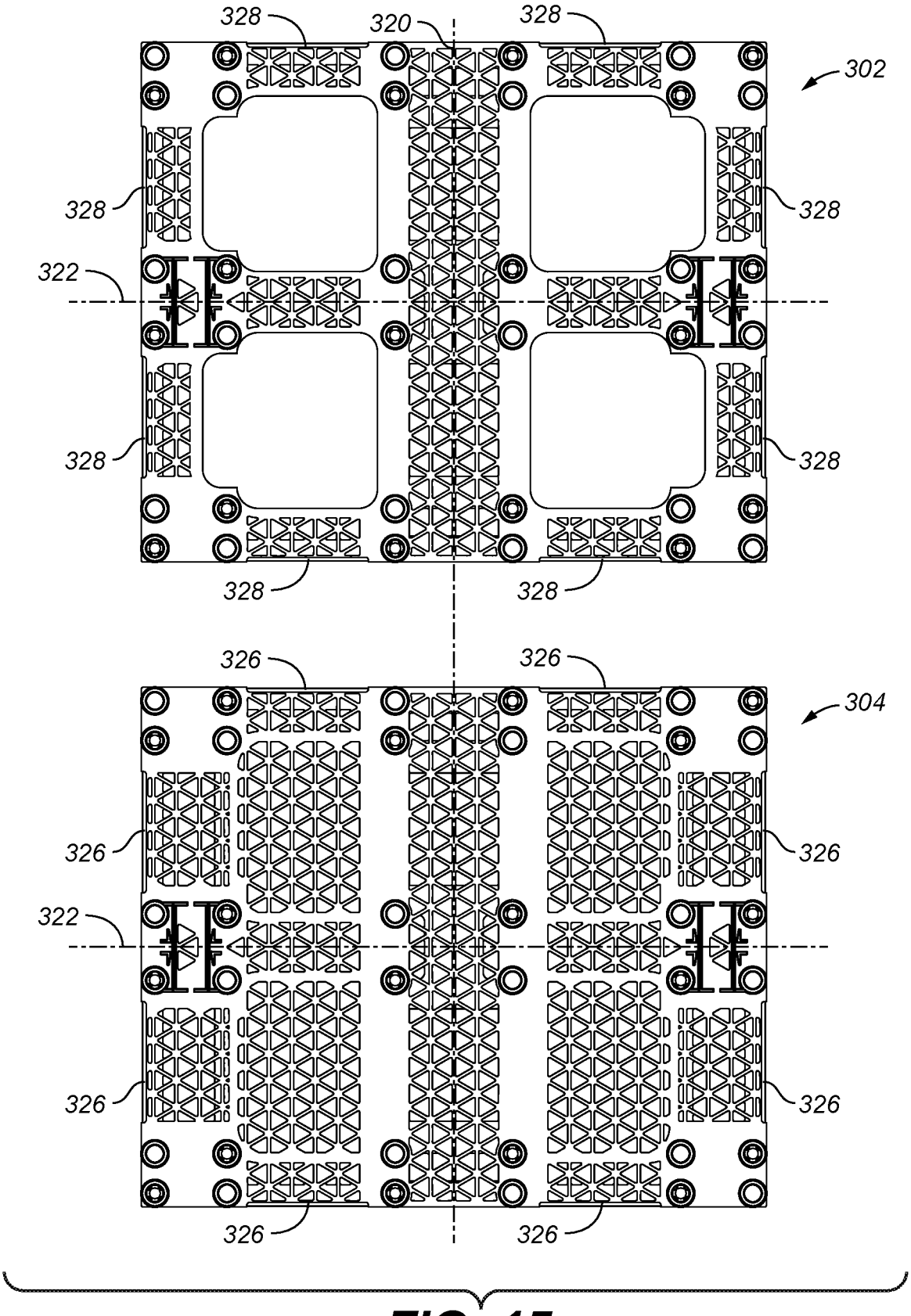
FIG. 15 depicts plan top view of the bottom portion 302 top side 308 and the top portion 304 bottom side 312 of the trackable nylon pallet of FIG. 12.

Embodiments of the nylon pallet bottom portion 302 provide a plurality of equal sized upstanding nylon posts affixed to the bottom portion top side 308 in four equal sized arrays of four upstanding nylon posts in the four corners 318 of the bottom portion top side 308, three equal sized arrays of four upstanding nylon posts along a central axis 320 of the bottom portion length sides 314 with two equal sized arrays near the center portion of each length side 314 and the third equal array centered between the two equal sized arrays near the center portion of each length side 314 in the center of the bottom portion top side 308, FIG. 13, and two equal sized arrays of four upstanding nylon posts along a central axis of the bottom portion width sides 322 with one array near the center portion of each width side 316, FIGS. 12-15. For these embodiments, each array of four upstanding nylon posts includes two diagonally disposed upstanding nylon posts further comprising extended nylon attachment clips 42 and two diagonally opposed upstanding nylon posts comprising an open end sized to receive an attachment clip 36, FIGS. 13, 14, and 20.

Figure 1:
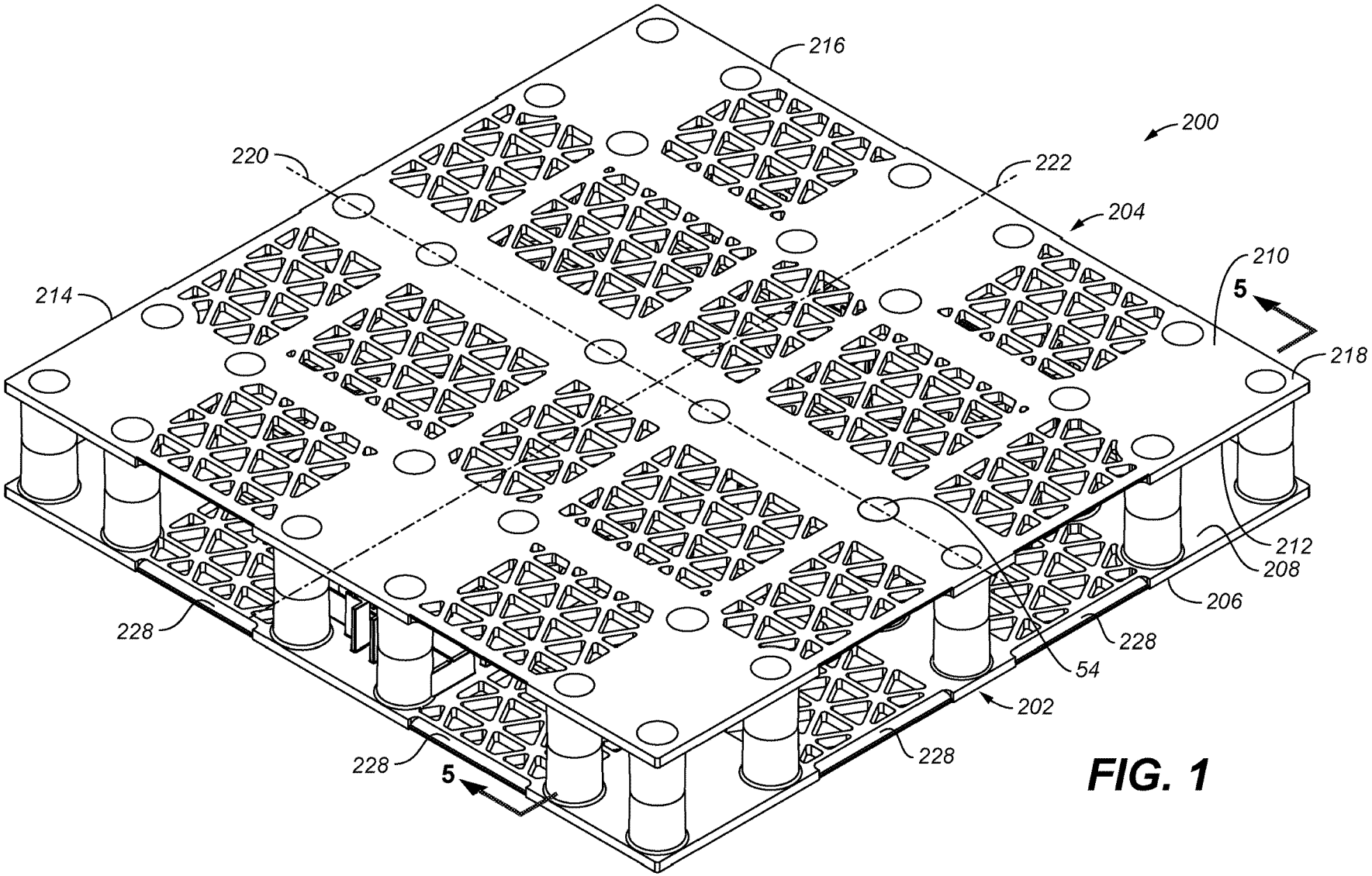
FIG. 1 depicts a top right perspective view of an embodiment of trackable nylon pallet 200.
Figure 2:
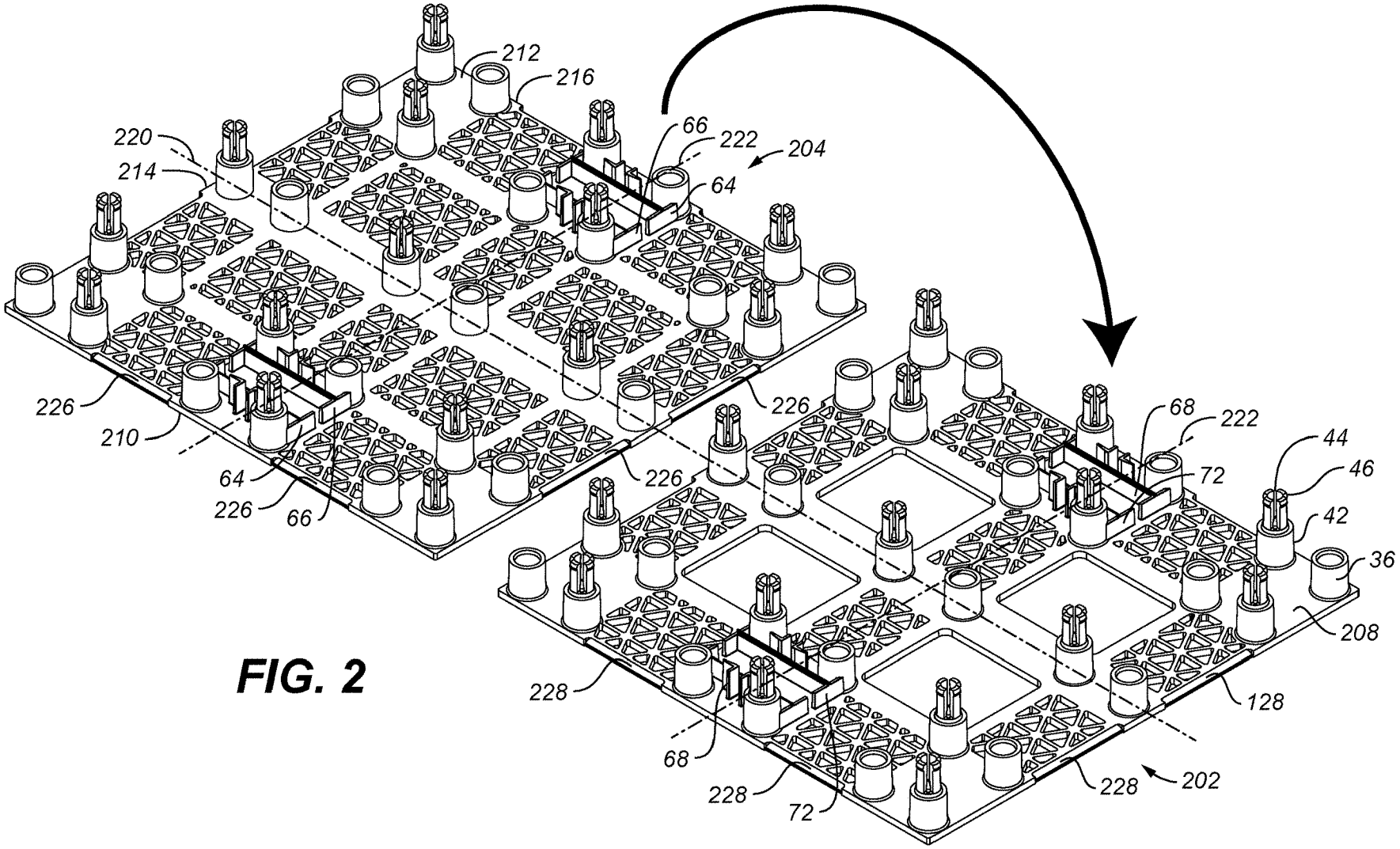
FIG. 2 depicts top right perspective views of the top portion 204 and bottom potion 202 of the trackable nylon pallet of FIG. 1 before the top and bottom portions are connected.
Figure 3:
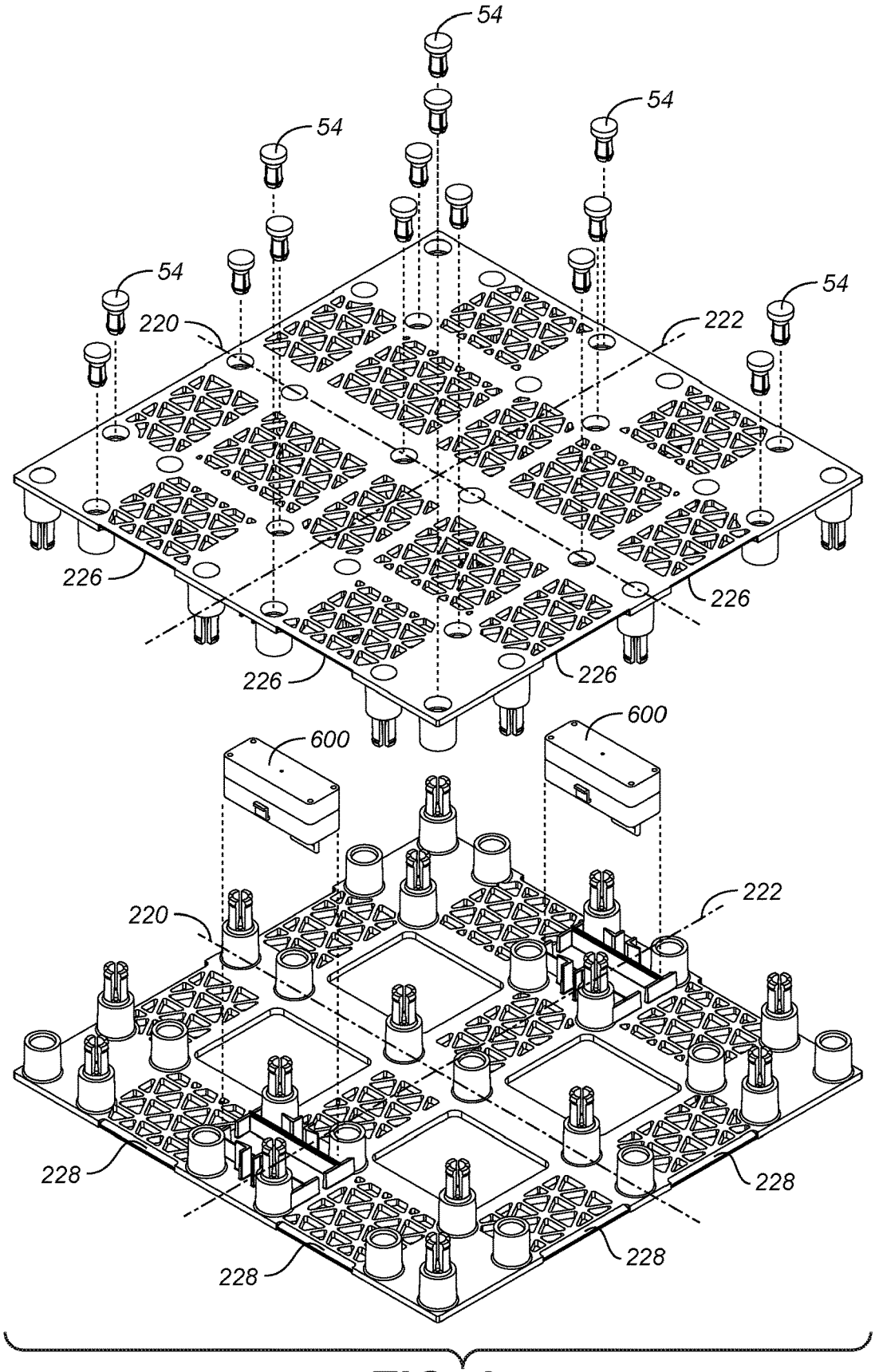
FIG. 3 depicts top right perspective views of the alignment of top portion 204 and bottom potion 202 of the trackable nylon pallet of FIG. 1 before the top and bottom portions are connected.
Figure 4:
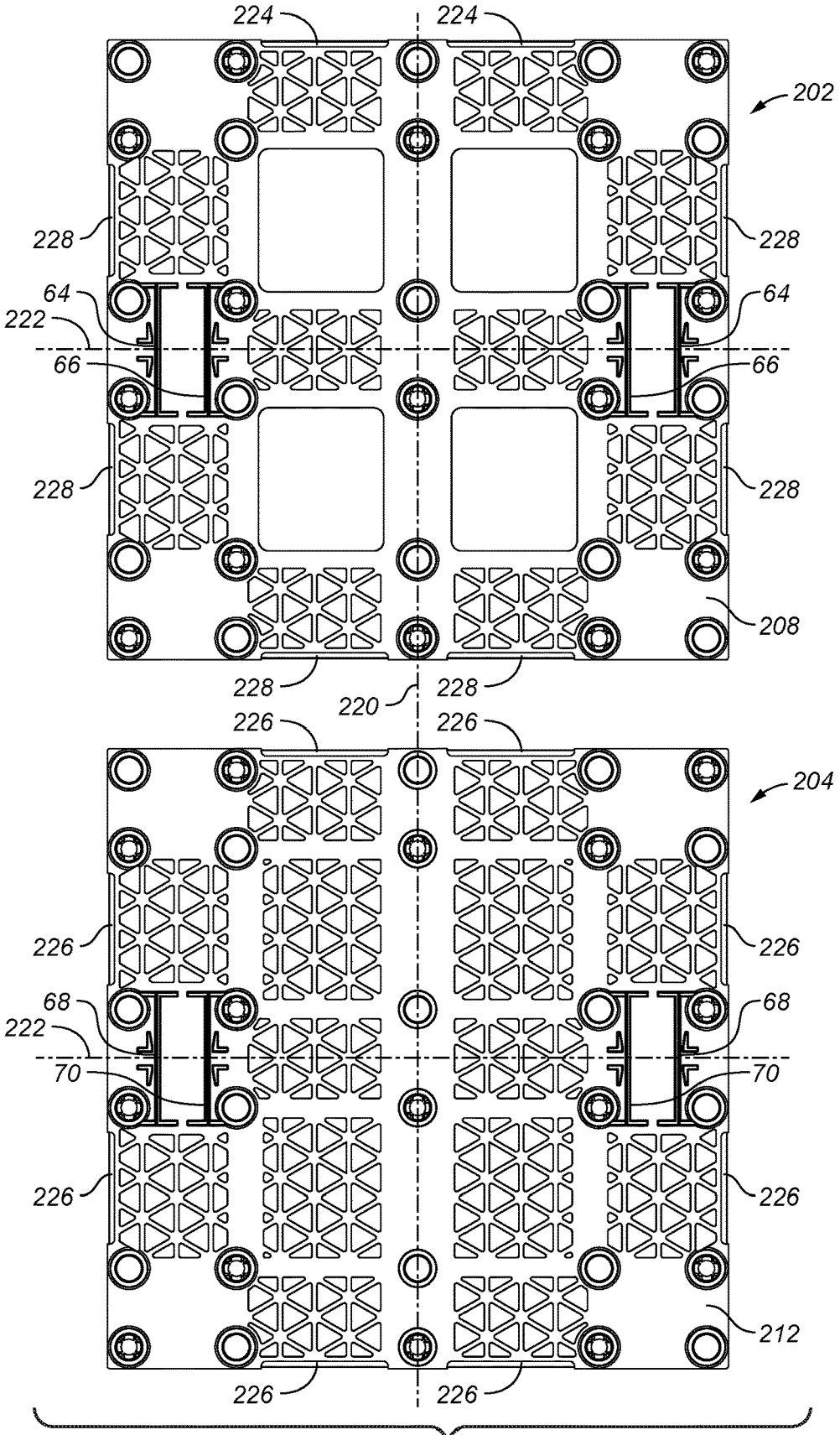
FIG. 4 depicts plan top view of the bottom portion 202 top side 208 and the top portion 204 bottom side 212 of the trackable nylon pallet of FIG. 1.
Figure 5:
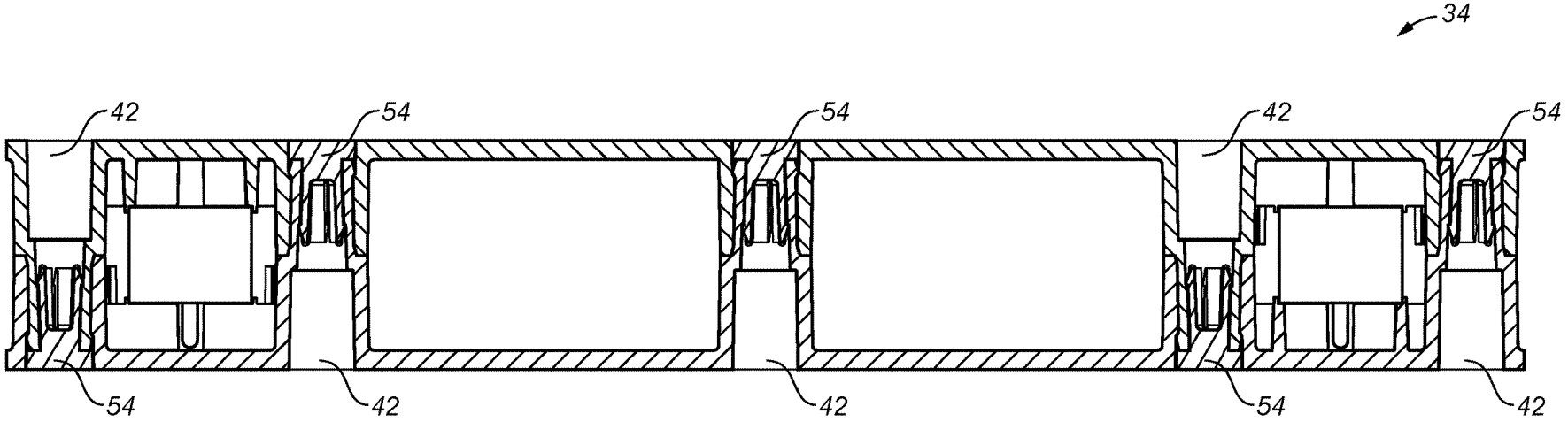
FIG. 5 is a sectional view of the trackable nylon pallet of FIG. 1 taken at "5-5."

Embodiments of the nylon pallet bottom portion 202 provide a plurality of equal sized upstanding nylon posts affixed to the bottom portion top side 208 in four equal sized arrays of four upstanding nylon posts in the four corners 218 of the bottom portion top side 208, three equal sized arrays of two upstanding nylon posts along a central axis 220 of the bottom portion length sides 214 with two equal sized arrays near the center portion of each length side 214 and the third equal array centered between the two equal arrays near the center portion of each length side 214 in the center of the bottom portion top side 208, and two equal sized arrays of four upstanding nylon posts along a central axis 222 of the bottom portion width sides 216 with one array near the center portion of each width side 216, FIGS. 2 and 3. For these embodiments, each equal sized array of four upstanding nylon posts includes two diagonally disposed upstanding nylon posts further comprising extended nylon attachment clips 42 and two diagonally opposed upstanding nylon posts comprising an open end sized to receive an attachment clip 36, FIG. 20. For these embodiments, each equal sized array of two upstanding nylon posts includes one upstanding nylon post having an open end sized to receive an extended attachment clip 36 and one upstanding nylon post with an extended attachment clip 42.

Figure 9:
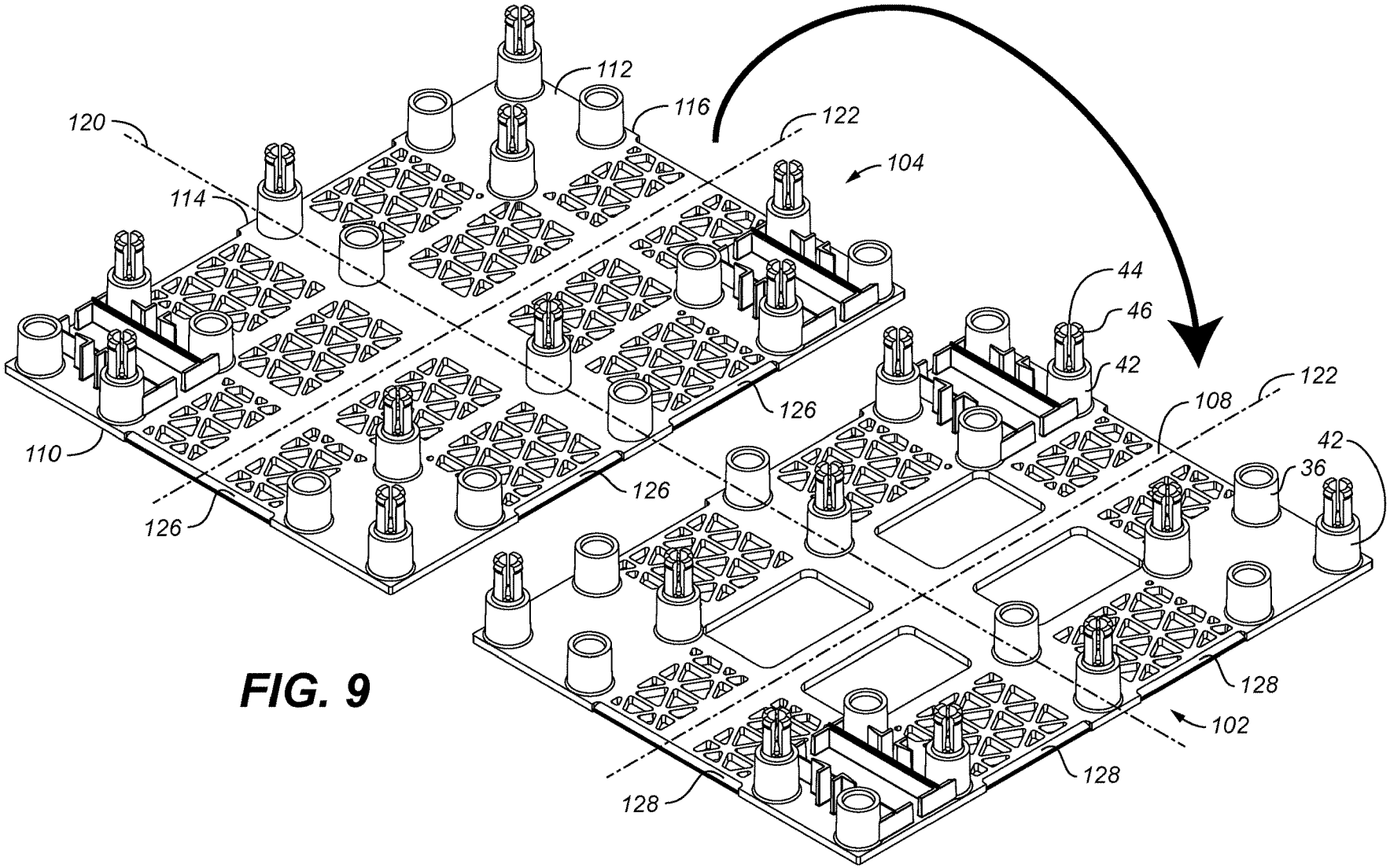
FIG. 9 depicts top right perspective views of the top portion 104 and bottom potion 102 of the trackable nylon pallet of FIG. 8 before the top and bottom portions are connected.
Figure 10:
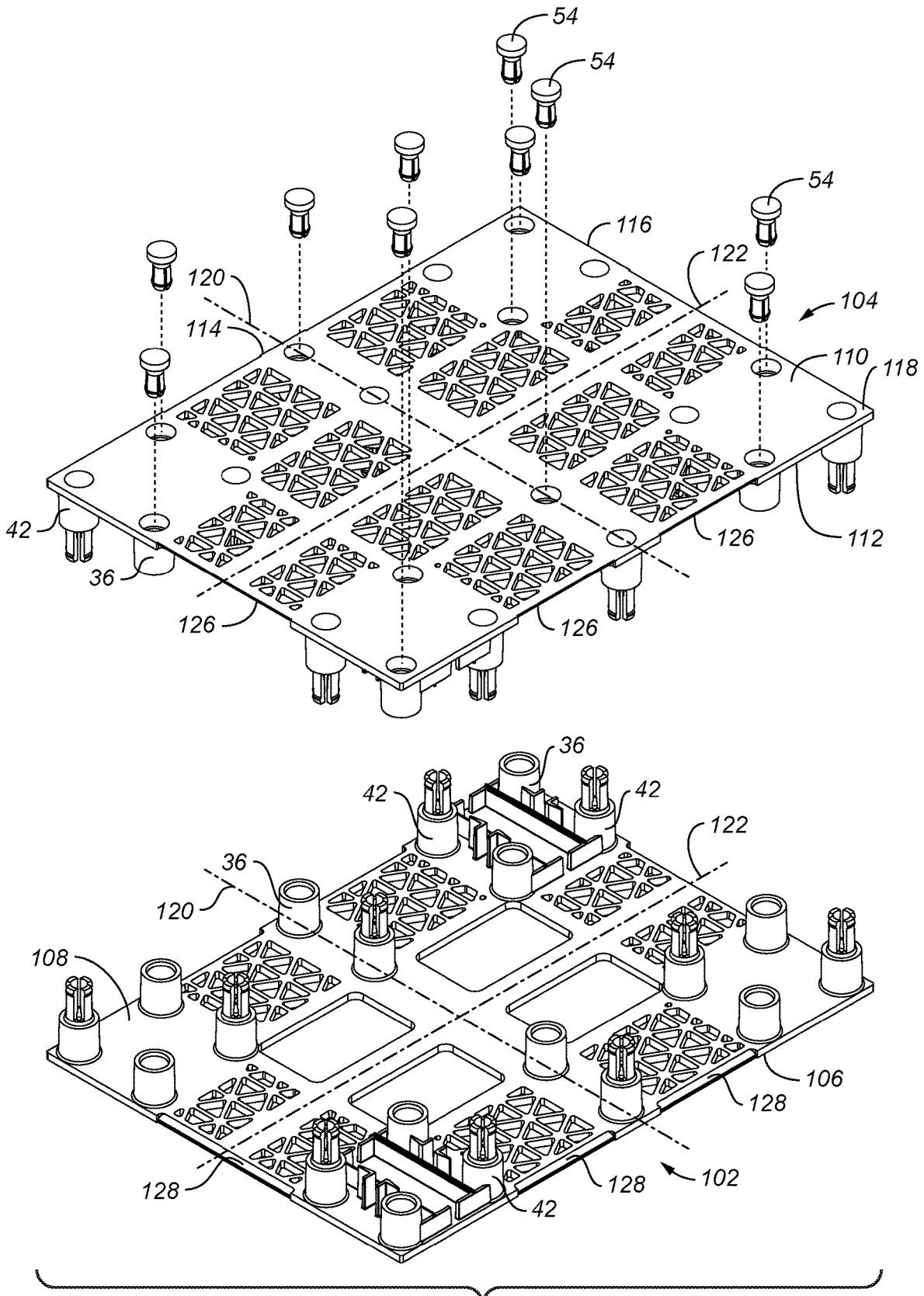
FIG. 10 depicts top right perspective views of the alignment of top portion 104 and bottom potion 102 of the trackable nylon pallet of FIG. 8 before the top and bottom portions are connected.
Figure 11:
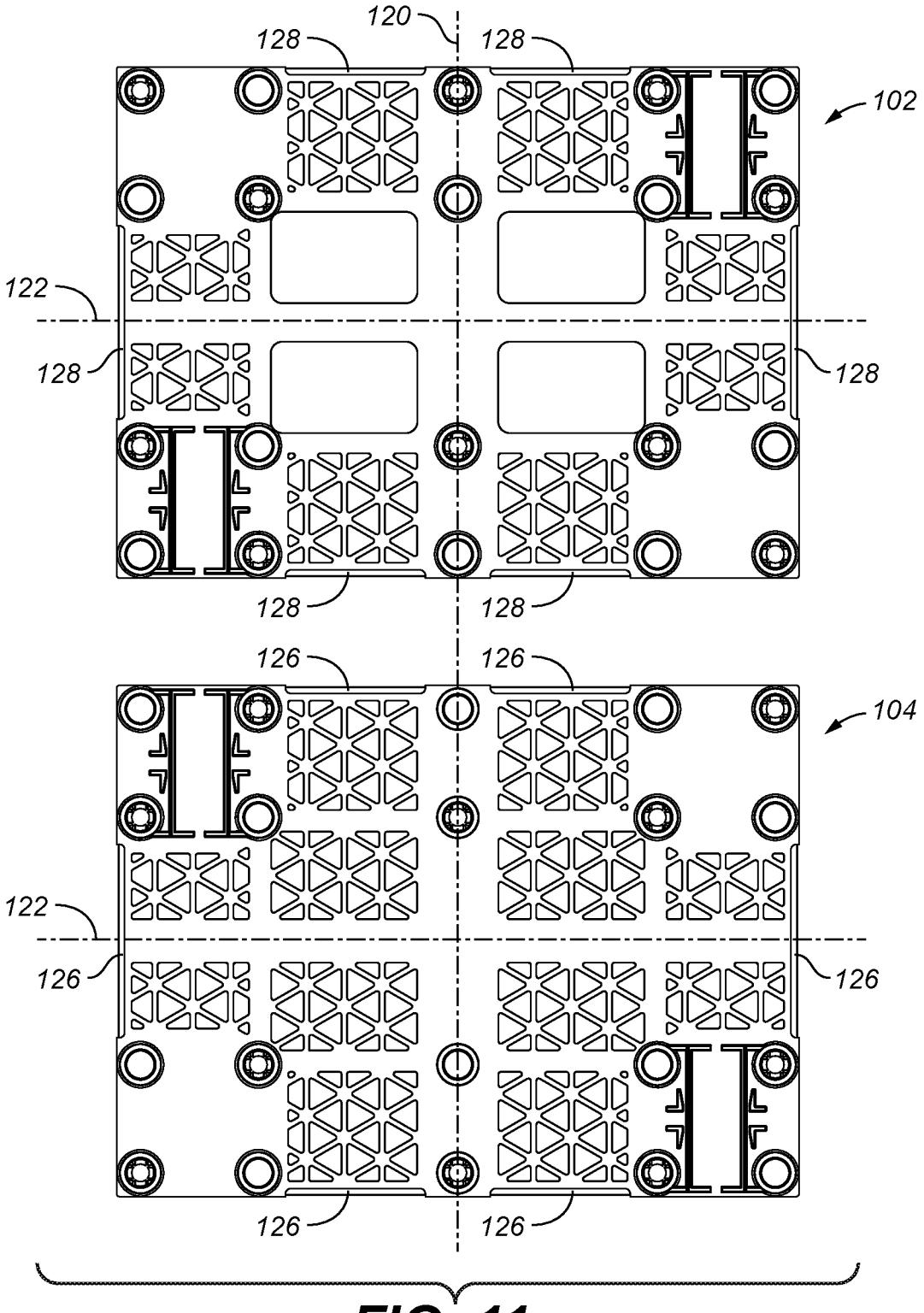
FIG. 11 depicts plan top view of the bottom portion 102 top side 108 and the top portion 104 bottom side 112 of the trackable nylon pallet of FIG. 8.
Figure 12:
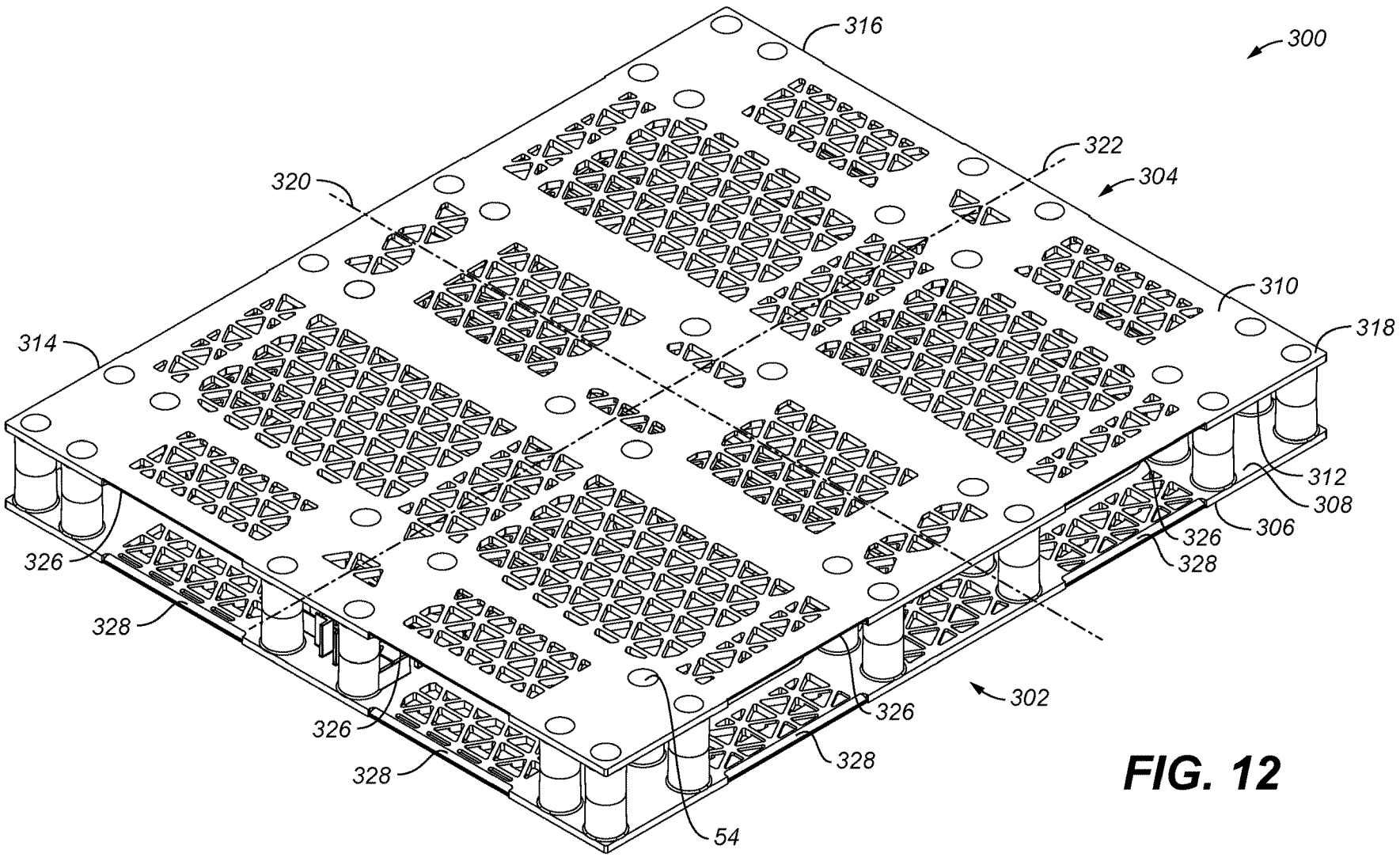
FIG. 12 depicts a top right perspective view of an embodiment of trackable nylon pallet 300.

Embodiments of the nylon pallet bottom portion 102 provide a plurality of equal sized upstanding nylon posts affixed to the bottom portion top side 108 in four equal sized arrays of four upstanding nylon posts in the four corners 118 of the bottom portion top side 108, and two equal sized arrays of two upstanding nylon posts along a central axis 220 of the pallet length sides 114, each equal sized array of two upstanding nylon posts equidistant from the two equal sized arrays in the corners of each pallet length side 114, FIGS. 9 and 10. For these embodiments, each equal sized array of four upstanding nylon posts includes two diagonally disposed upstanding nylon posts further comprising extended nylon attachment clips 42 and two diagonally opposed upstanding nylon posts comprising an open end sized to receive an attachment clip 36, FIG. 20. For these embodiments, each equal sized array of two upstanding nylon posts includes one upstanding nylon post having an open end sized to receive an extended attachment clip 36 and one upstanding nylon post with an extended attachment clip 42.

Figure 16:
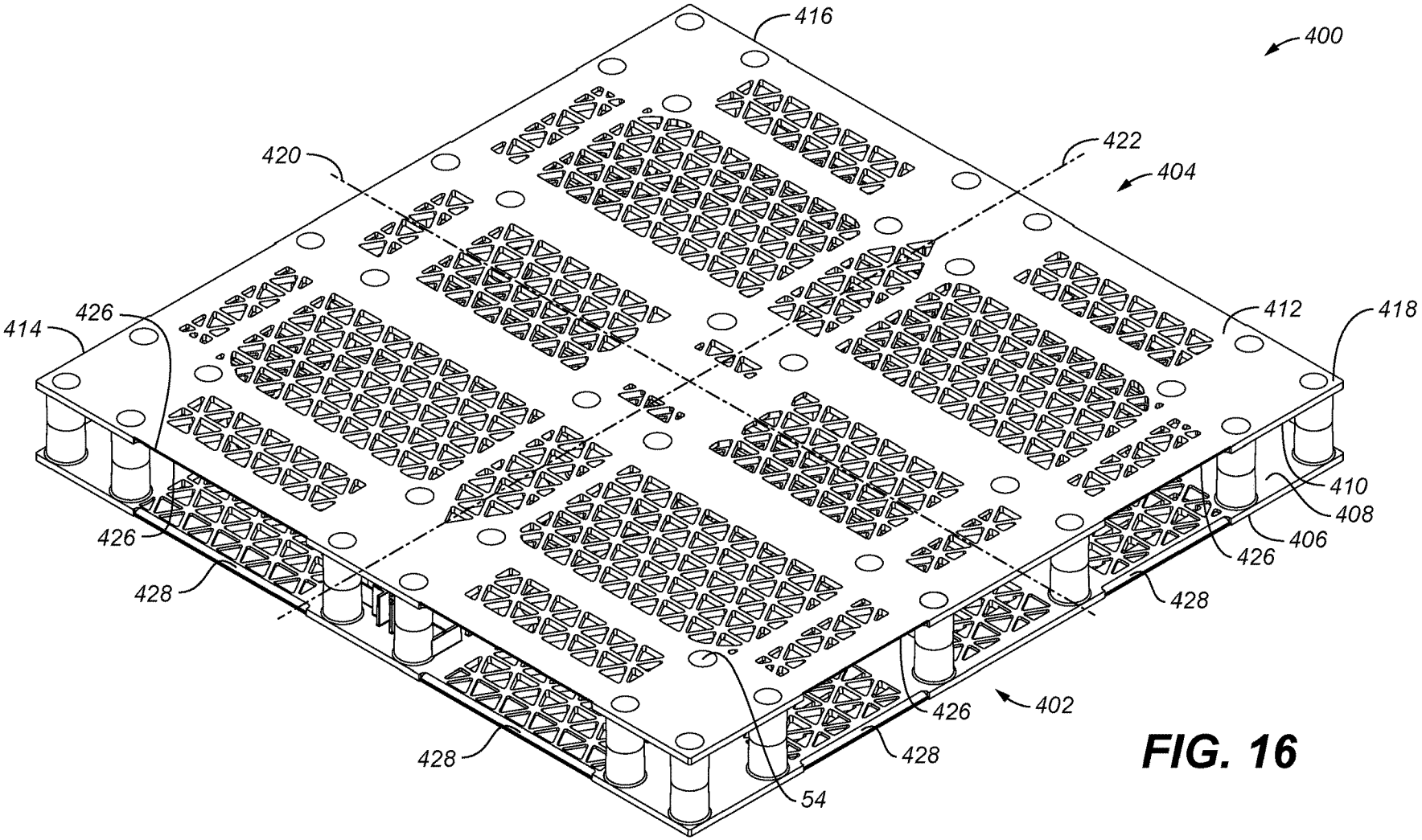
FIG. 16 depicts a top right perspective view of an embodiment of trackable nylon pallet 400.
Figure 17:
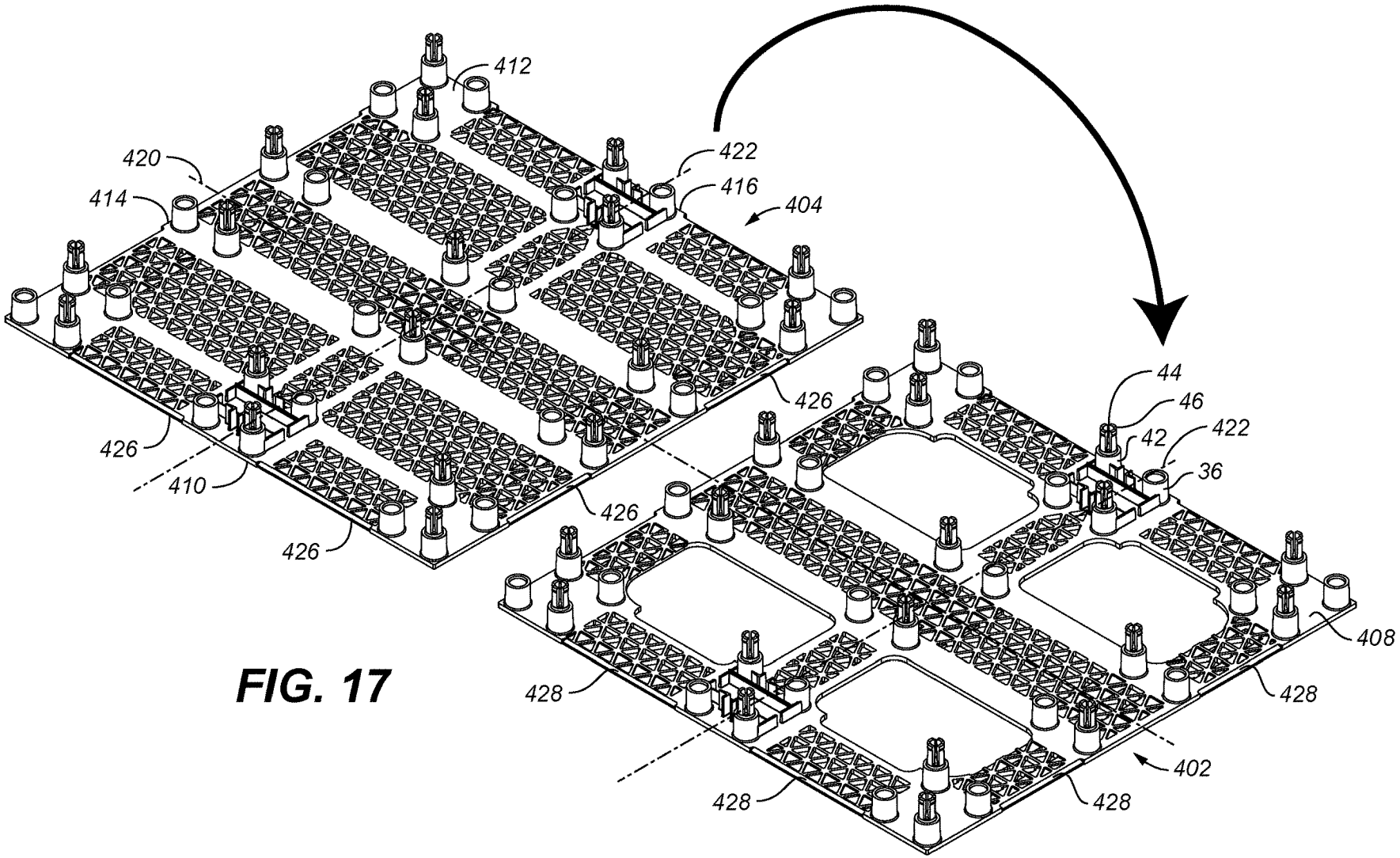
FIG. 17 depicts top right perspective views of the top portion 404 and bottom potion 402 of the trackable nylon pallet of FIG. 16 before the top and bottom portions are connected.
Figure 18:
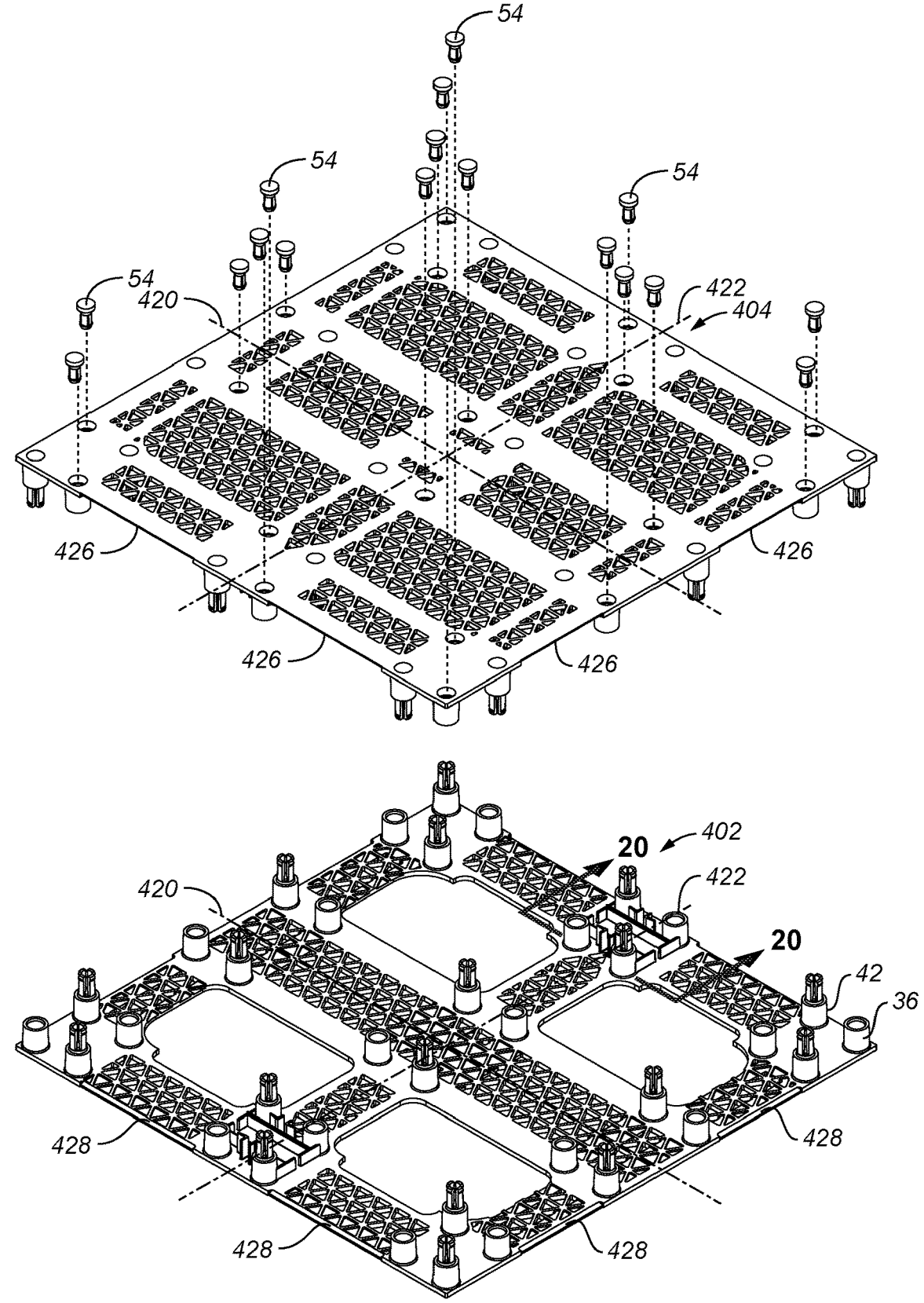
FIG. 18 depicts top right perspective views of the alignment of top portion 404 and bottom potion 402 of the trackable nylon pallet of FIG. 16 before the top and bottom portions are connected.
Figure 19:
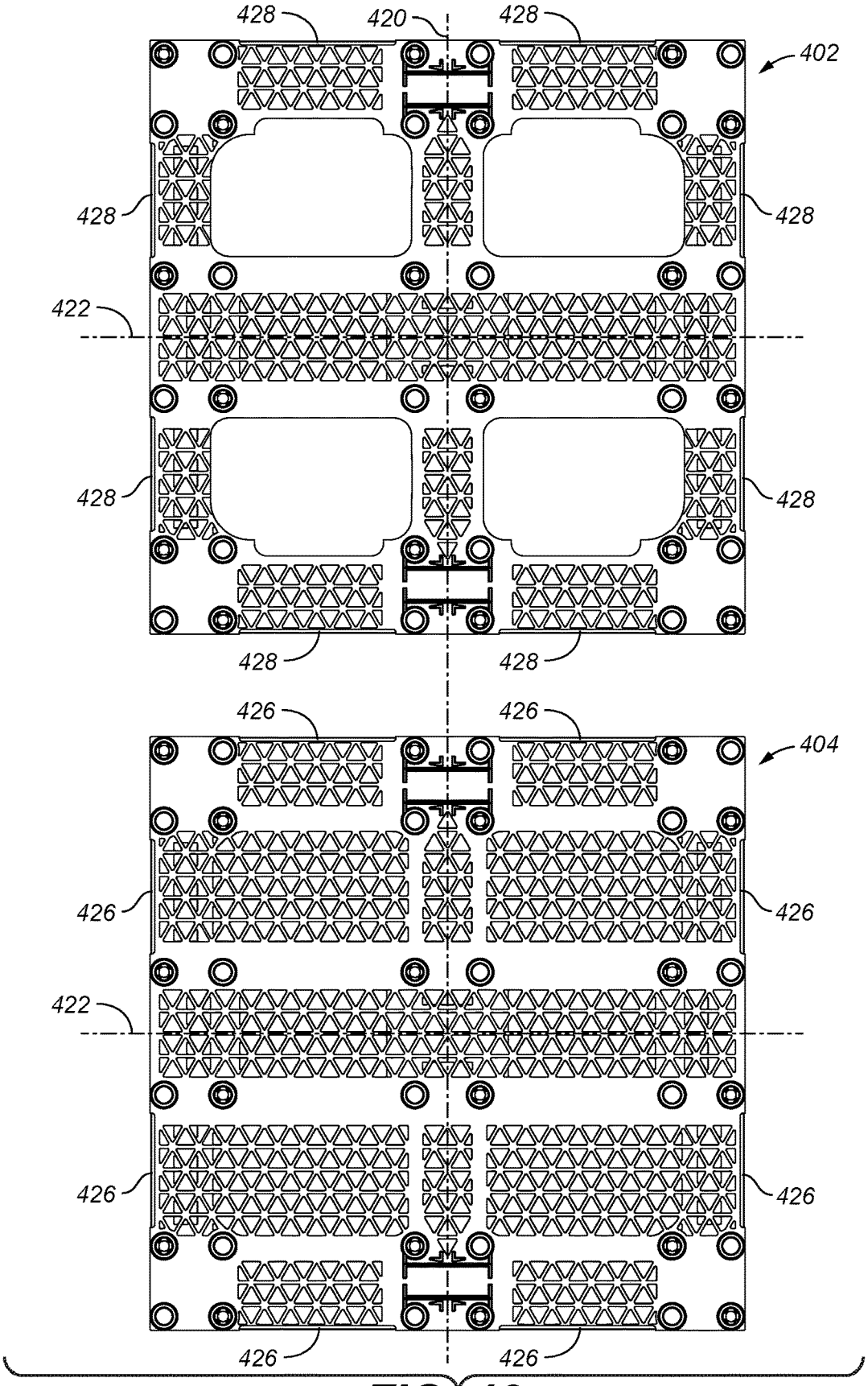
FIG. 19 depicts plan top view of the bottom portion 402 top side 408 and the top portion 404 bottom side 412 of the trackable nylon pallet of FIG. 16.
Figure 20:
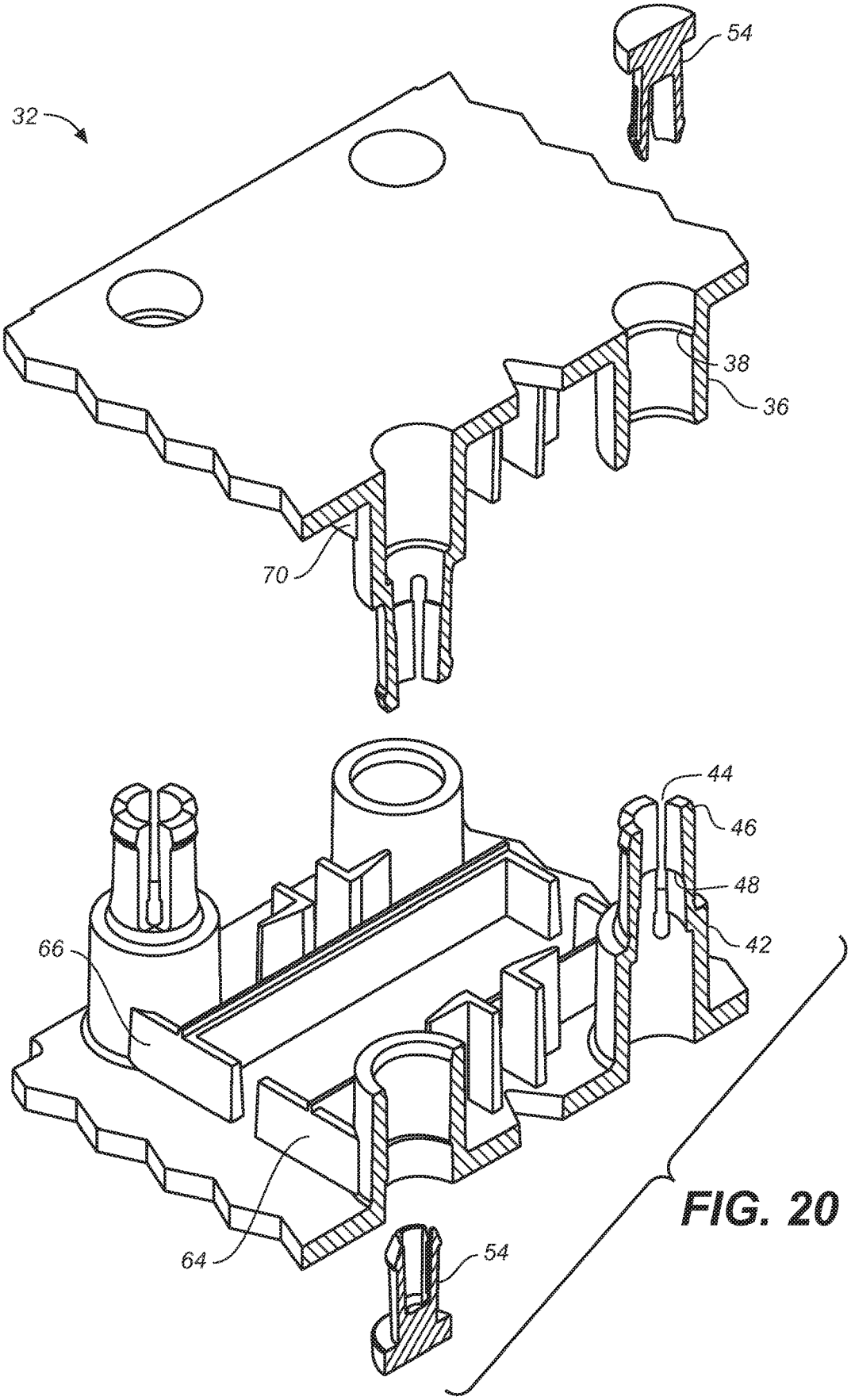
FIG. 20 is a representative top right perspective sectional view of FIG. 18 taken at "22-22" depicting a two-by-two array of upstanding post open ends 36, upstanding posts with extended attachment clips 42, and locking pins 54 between top portion 404 and bottom portion 402.

Embodiments of the nylon pallet bottom portion 402 provide a plurality of equal sized upstanding nylon posts affixed to the bottom portion top side 408 in four equal sized arrays of four upstanding nylon posts in the four corners 418 of the bottom portion top side 408, three equal sized arrays of four upstanding nylon posts along a central axis 420 of the pallet length sides 414 with two equal sized arrays near the center portion of each pallet length side 414 and the third equal array centered between the two equal sized arrays near the center portion of each length side 414 in the center of the bottom portion top side 408, FIG. 17, and two equal sized arrays of four upstanding nylon posts along a central axis 422 of the pallet width sides 416 with one array near the center portion of each width side 16, FIGS. 16-18. For these embodiments, each array of four upstanding nylon posts includes two diagonally disposed upstanding nylon posts further comprising extended nylon attachment clips 42 and two diagonally opposed upstanding nylon posts comprising an open end sized to receive an attachment clip 36, FIGS. 17, 18, and 20.

Embodiments of the nylon pallet bottom portion 202, 302, and 402 including two equal sized arrays of four upstanding nylon posts along a central axis 222, 322, and 422, respectively, of the pallet width sides 216, 316, and 416, respectively, further include at least one such array providing equal sized nylon frame sides 68 and 70 between upstanding nylon posts 36 and 42, the frame sides 68 and 70 orthogonally disposed to the central axis 222, 322, and 422, of the pallet width sides 216, 316, and 416, respectively, FIGS. 2, 3, 12, 13, 17 and 18.

Embodiments of the nylon pallet bottom portion 102 including two equal sized arrays of four upstanding nylon posts in each corner of the bottom portion top side 108 further include at least one such array providing equal sized nylon frame sides 68 and 70 between upstanding nylon posts 36 and 42, the frame sides 68 and 70 orthogonally disposed to the central axis 120 of the pallet length sides 114, FIGS. 9 and 10.

Embodiments of the nylon pallet 100, 200, 300, and 400 provide a rigid, injection molded nylon top portion 104, 204, 304, and 404, respectively, of equal size to each respective pallet bottom portion 102, 202, 302, and 402, respectively, and including a top portion bottom side 112, 212, 312, and 412, respectively, and a top portion planar top side, 110, 210, 310, and 410, respectively, FIGS. 1-20.

Embodiments of the nylon pallet top portion 104, 204, 304, and 404, include two equal pallet length sides, 114, 214, 314, and 414, respectively, two equal pallet width sides, 116, 216, 316, and 416, respectively, and four ninety-degree corners, 118, 218, 318, and 418, respectively, FIGS. 1-5, 8-19.

Embodiments of the nylon pallet top portion 304 include a plurality of equal sized upstanding nylon posts affixed to the top portion bottom side 312 in four equal sized arrays of four upstanding nylon posts in the four corners 318 of the top portion bottom side 312, three equal sized arrays of four upstanding nylon posts along a central axis 320 of the pallet length sides 314 with two equal sized arrays each near the center portion of each separate pallet length side 314 edge and the third equal array centered between the two arrays in the center of each separate pallet length side 314 in the center of the top portion bottom side 312, and two equal sized arrays of four upstanding nylon posts along a central axis of the pallet width sides 316 with each array near the center portion of each pallet width side 316 edge, FIGS. 12-15. For these embodiments, each array of four upstanding nylon posts includes two diagonally disposed upstanding nylon posts each with an extended nylon attachment clip 42 and two diagonally opposed upstanding nylon posts each providing an open end 36 sized to receive and hold a post with the extended nylon attachment clip, FIGS. 13, 14, and 20.

Embodiments of the nylon pallet top portion 204 provide a plurality of equal sized upstanding nylon posts affixed to the top portion bottom side 212 in four equal sized arrays of four upstanding nylon posts in the four corners 218 of the top portion bottom side 212, three equal sized arrays of two upstanding nylon posts along a central axis 220 of the pallet length sides 214 with two equal sized arrays near the center portion of each length side 214 edge and the third equal array centered between the two arrays near the center portion of each length side 214 edge in the center of the top portion bottom side 212, and two equal sized arrays of four upstanding nylon posts along a central axis of the pallet width sides 216 with one array near the center portion of each width side 216 edge, FIGS. 2 and 3. For these embodiments, each equal sized array of four upstanding nylon posts includes two diagonally disposed upstanding nylon posts each providing an extended nylon attachment clip 42 and two diagonally opposed upstanding nylon posts comprising an open end 36 sized to receive and hold a corresponding upstanding nylon post providing an extended nylon attachment clip 42, FIG. 20. For these embodiments, each array of two upstanding nylon posts provides one upstanding nylon post with an open end 36 and one upstanding nylon post including an extended nylon attachment clip 42 along the central axis 220 of the pallet length sides 214.

Embodiments of the nylon pallet top portion 104 provide a plurality of equal sized upstanding nylon posts affixed to the top portion bottom side 112 in four equal sized arrays of four upstanding nylon posts in the four corners 118 of the top portion bottom side 112, and two equal sized arrays of two upstanding nylon posts along a central axis 120 of the pallet length sides 114 each array of two upstanding nylon posts near the center portion of each length side 114 edge, FIGS. 9 and 10. For these embodiments, each equal sized array of four upstanding nylon posts includes two diagonally disposed upstanding nylon posts each providing an extended nylon attachment clip 42 and two diagonally opposed upstanding nylon posts comprising an open end 36 sized to receive and hold a corresponding upstanding nylon post providing an extended nylon attachment clip 42, FIG. 20. For these embodiments, each array of two upstanding nylon posts provides one upstanding nylon post with an open end 36 and one upstanding nylon post including an extended nylon attachment clip 42 along the central axis 120 of the pallet length sides 114.

Embodiments of the nylon pallet top portion 404 include a plurality of equal sized upstanding nylon posts affixed to the top portion bottom side 412 in four equal sized arrays of four upstanding nylon posts in the four corners 418 of the top portion bottom side 412, three equal sized arrays of four upstanding nylon posts along a central axis 420 of the pallet length sides 414 with two equal sized arrays each near the center portion of each separate pallet length side 414 edge and the third equal array centered between the two arrays in the center of each separate pallet length side 414 in the center of the top portion bottom side 412, and two equal sized arrays of four upstanding nylon posts along a central axis of the pallet width sides 416 with each array near the center portion of each pallet width side 416 edge, FIGS. 16-19. For these embodiments, each array of four upstanding nylon posts includes two diagonally disposed upstanding nylon posts each with an extended nylon attachment clip 42 and two diagonally opposed upstanding nylon posts each providing an open end 36 sized to receive and hold a post with the extended nylon attachment clip, FIGS. 17, 18, and 20.

Embodiments of the nylon pallet top portions 104, 204, 304, and 404, and nylon pallet bottom portions, 102, 202, 302, and 402, FIGS. 1-5, and 8-19, include mirror image arrays of equal sized upstanding nylon posts each providing an extended nylon attachment clip 42 and equal sized upstanding nylon posts each including an open end 36 sized to receive and hold an upstanding nylon post providing an extended attachment clip 42. When nylon pellet top portion 104, 204, 304 and 404 bottom side 112, 212, 314, and 412, respectively, arrays of upstanding nylon posts are fitted onto arrays of upstanding nylon posts in a corresponding nylon pallet bottom portion 102, 202, 304, 404, top side 108, 208, 308, 408, respectively, each respective upstanding nylon post open end 36 receives and holds a corresponding upstanding nylon post providing an extended nylon attachment clip 42, FIGS. 2, 9, 13, and 17, respectively. A nylon locking pin 54, secures and locks each upstanding extended nylon attachment clip 42 into its corresponding upstanding nylon post open end 36, FIGS. 3, 10, 14, and 18, respectively, from the nylon pallet bottom portion planar bottom side, 106, 206, 306, and 406, respectively, and the nylon pallet top portion planar top side 110, 210, 310, and 410, respectively. It is understood by person having skill in the art that the nylon locking pin 54 is attached from both the top portion planar top surface, FIGS. 3, 10, 14 and 18, and the bottom portion planar bottom surface (not shown) to each pairing of an upstanding nylon post further comprising an extended nylon attachment clip 42 and an upstanding nylon post comprising an open end sized to receive an attachment clip 36 for all embodiments of the nylon pallet, FIGS. 5 and 22.

Embodiments of the nylon pallet top portion bottom side 212, 312, 412 including two equal sized arrays of four upstanding nylon posts along a central axis of the top portion width sides 222, 322, 422, respectively, FIGS. 13, 14, 17, and 18, further include at least one such array providing equal sized nylon frame sides 68 and 70 between upstanding nylon posts corresponding to the equal sized frame sides 64 and 66 between upstanding nylon posts of the bottom portion top side, 208, 308, 408, respectively, the frame sides orthogonally disposed to the central axis of the top portion width sides, 222, 322, 422, respectively FIGS. 2, 3, 12, 13, 17 and 18.

Figure 8:
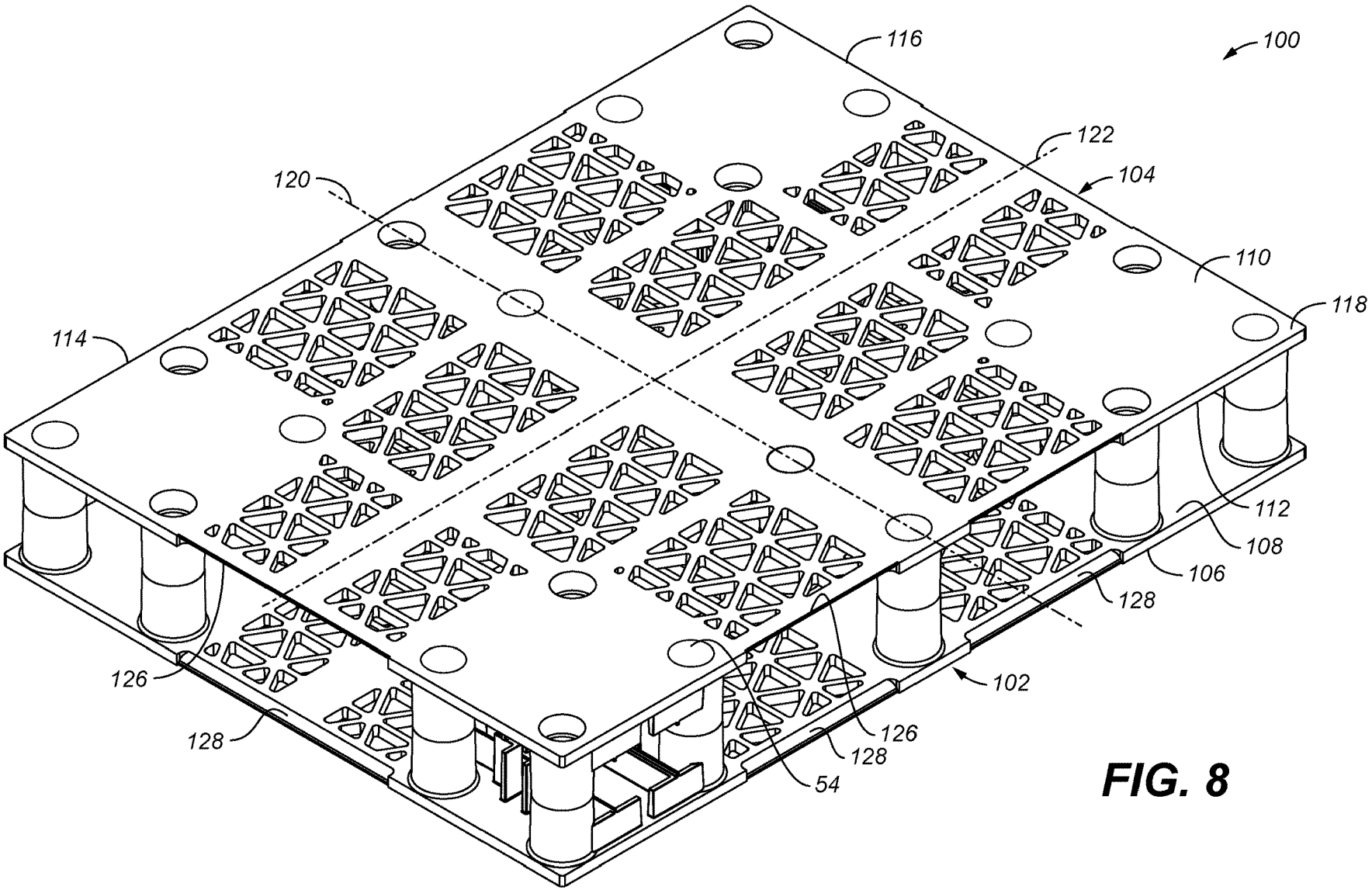
FIG. 8 depicts a top right perspective view of an embodiment of trackable nylon pallet 100.

Embodiments of the nylon pallet top portion including four equal sized arrays of four upstanding nylon posts in the four corners of the top portion bottom side 112, FIGS. 8 and 9, further provide at least one such array providing equal sized nylon frame sides 68 and 70 between upstanding nylon post corresponding to the equal sized frame sides 64 and 66 between upstanding nylon posts of the bottom portion top side 108, the frame sides orthogonally disposed to the central axis of the bottom portion width sides 122.

All embodiments of the nylon pallet 100, 200, 300, and 400 include a plurality of connection and locking assembly points between the pallet bottom portion 102, 202, 302, and 402, respectively, and the pallet top portion 104, 204, 304, and 404, respectively. These connection and locking assembly points are grouped in arrays of four or two and each connection and locking assembly point provides one upstanding nylon post open end 36 receiving one upstanding nylon post with an extended nylon attachment clip 42 from a corresponding array from the top or bottom portion. The extended nylon attachment clip external lip 46 engages an upstanding nylon post open end internal groove 38 and the nylon attachment clip compression slots 44 hold the engagement of the upstanding nylon post with extended attachment clip 42 and the upstanding nylon post open end 36 in place. A nylon locking pin 54 is inserted into each nylon attachment clip compression slot 44 to allow the nylon locking pin body lip 60 to engage the internal attachment clip compression slot 44 and lock the nylon attachment clip compression slot 44 into the nylon upstanding nylon post open end internal groove 38, FIGS. 3, 5, 6A, 10, 14, 18, and 20.

Embodiments of the nylon pallet top portion planar top side 110, 210, 310, and 410, and the nylon pallet bottom portion planar bottom side 106, 206, 306, and 406, include a nylon locking pin 54 to secure each upstanding nylon post with extended attachment clip 42 to each upstanding nylon post open end 36, FIGS. 3, 5, 6A—6C, 10, 14, 18, and 20.

All embodiments of the nylon pallet include a communication/sensor box 600 sized to be received and releasably held by the corresponding equal sized frame sides between upstanding nylon posts of the bottom portion and top portion, FIGS. 7, 3, 10, 14, and 18. The communication/sensor box 600 includes a rectangular open bottom portion 602 having attachment clips 606 on each external bottom portion length side, a global positioning antenna 612 affixed to the bottom surface of the bottom portion 602, a seal around the bottom portion open edge, and a threaded opening orthogonally disposed to the communication/sensor box bottom in each bottom portion corner. The communication/sensor box rectangular top portion 604 is sized to enclose the open bottom portion and includes a planar top surface, a threaded opening orthogonally disposed to the planar top surface in each top portion corner, a communication/sensor box vent 608 centered on the planar surface of top portion top planar surface is open through the communication/sensor box top portion 604 planar top surface, and an internal membrane below the vent hole and on a the bottom surface of the communication/sensor box top portion 604 top portion to provide for heat dissipation from, and gaseous airflow but not liquids into, the communication/sensor box 600 when the top portion is sealed to the bottom portion by four threaded fasteners 610 in the corners of the communication/sensor box top portion 604 and communication/sensor box bottom portion 602. The communication/sensor box 600 is sized to house at least one integral global positioning system, at least one integral radio frequency identification device, at least one integral temperature sensor, at least one integral sensor calibrated to detect chemicals, an integral power supply and connected wiring to power the components housed in the communication/sensor box 600. The communication/sensor box bottom portion external surface side clips 606 are sized to engage and releasably attach to the respective frame sides 64 and 66 extending upwards from the pallet bottom portion top side 108, 208, 308 or 408, and the communication/sensor box top portion 604 top surface is sized to be received by and be secured by the corresponding frame sides 68 and 70 extending downwards from the pallet top portion bottom side 112, 212, 312, or 412. The communications/sensor box 600 can be removed quickly from pallet installation for repair or replacement without disassembly of the pallet.

Figure 6A:
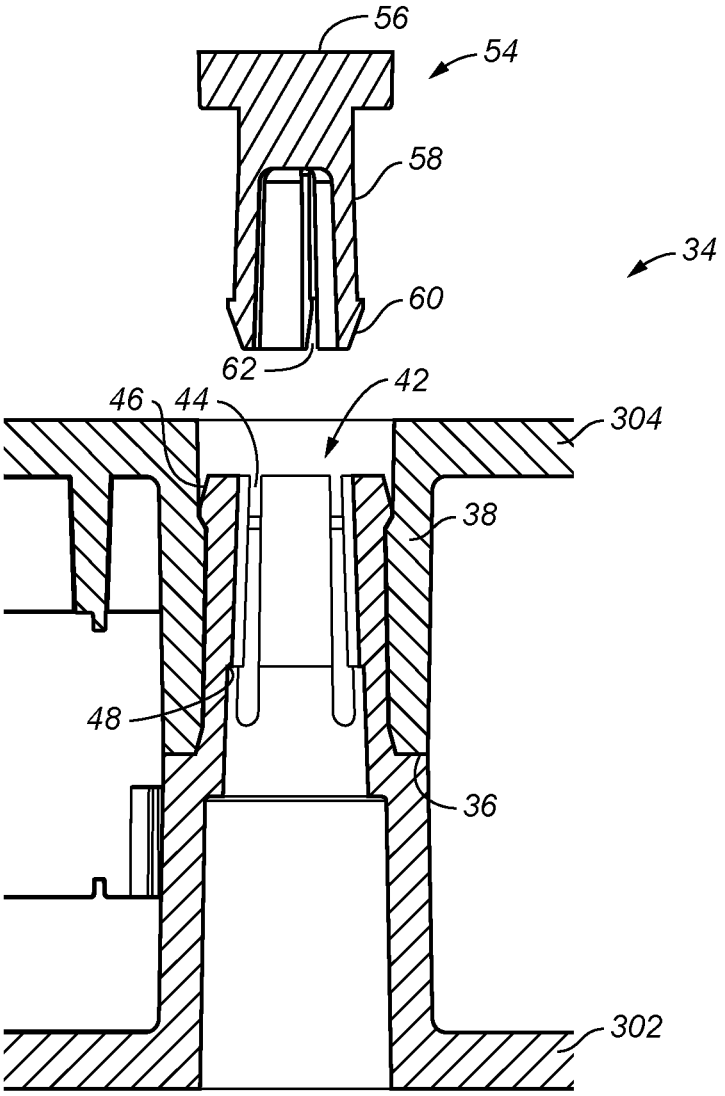
FIG. 6A is a representative plan sectional view 34 of a locking pin 54 to secure each upstanding post with extended attachment clip 42 to each upstanding post open end 36 for all embodiments of the trackable nylon pallets.
Figure 6B:
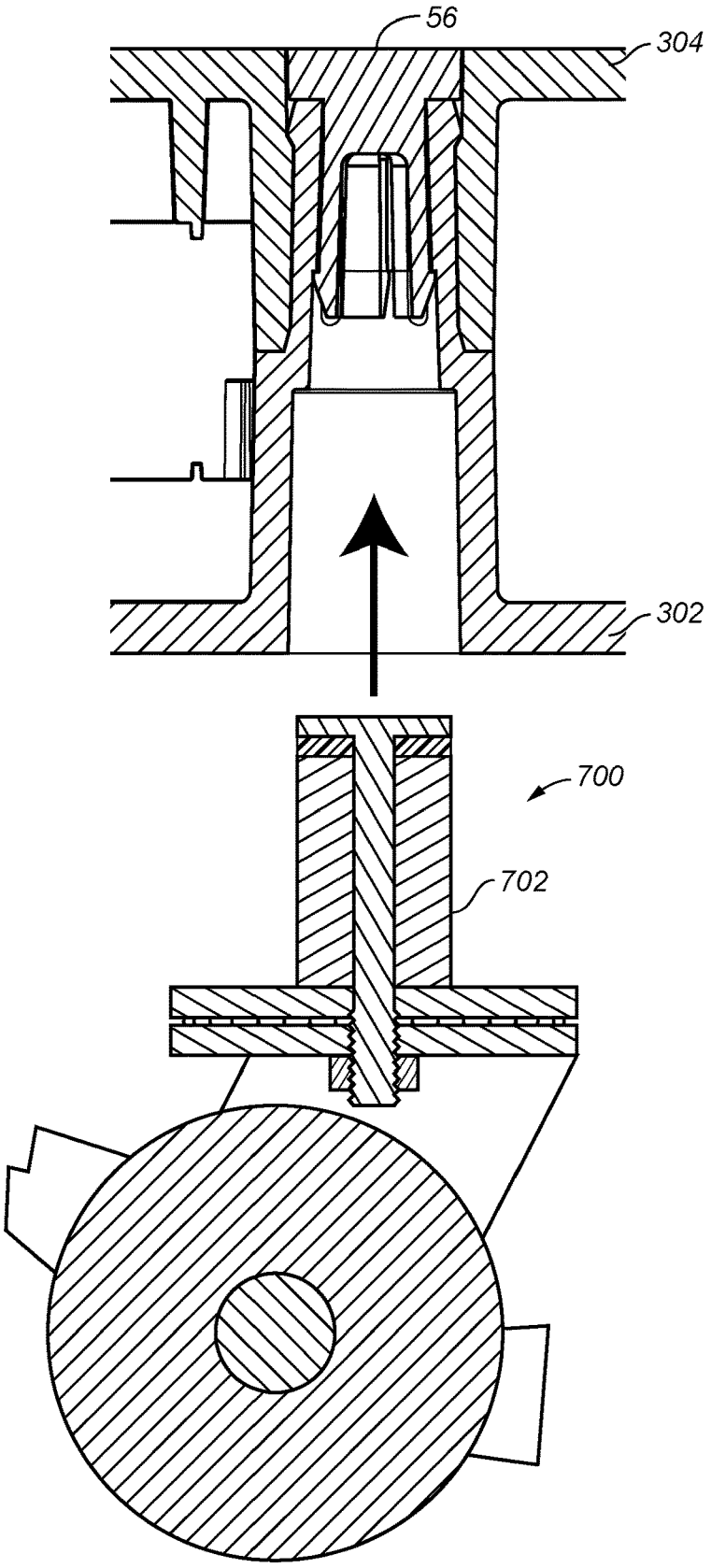
FIG. 6B is a representative plan sectional view 34 of a caster 700 with a caster head 702 to be received into an open bottom of the upstanding post with extended attachment clip 42 from the bottom portion planar side for all embodiments of the trackable nylon pallets.
Figure 6C:
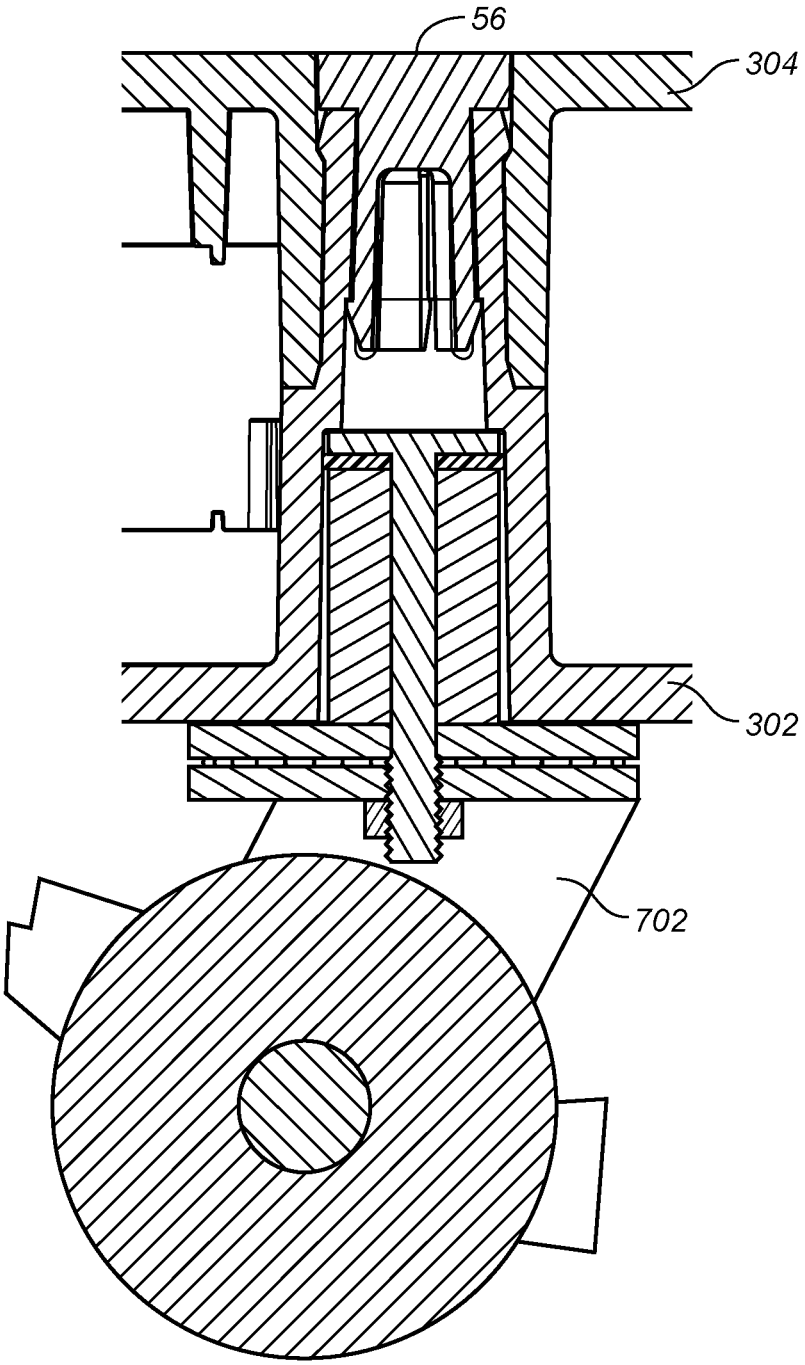
FIG. 6C is a representative plan sectional view of the caster head 702 releasably received within the open bottom of the upstanding post with extended attachment clip 42 of FIG. 6B.
Figure 7:
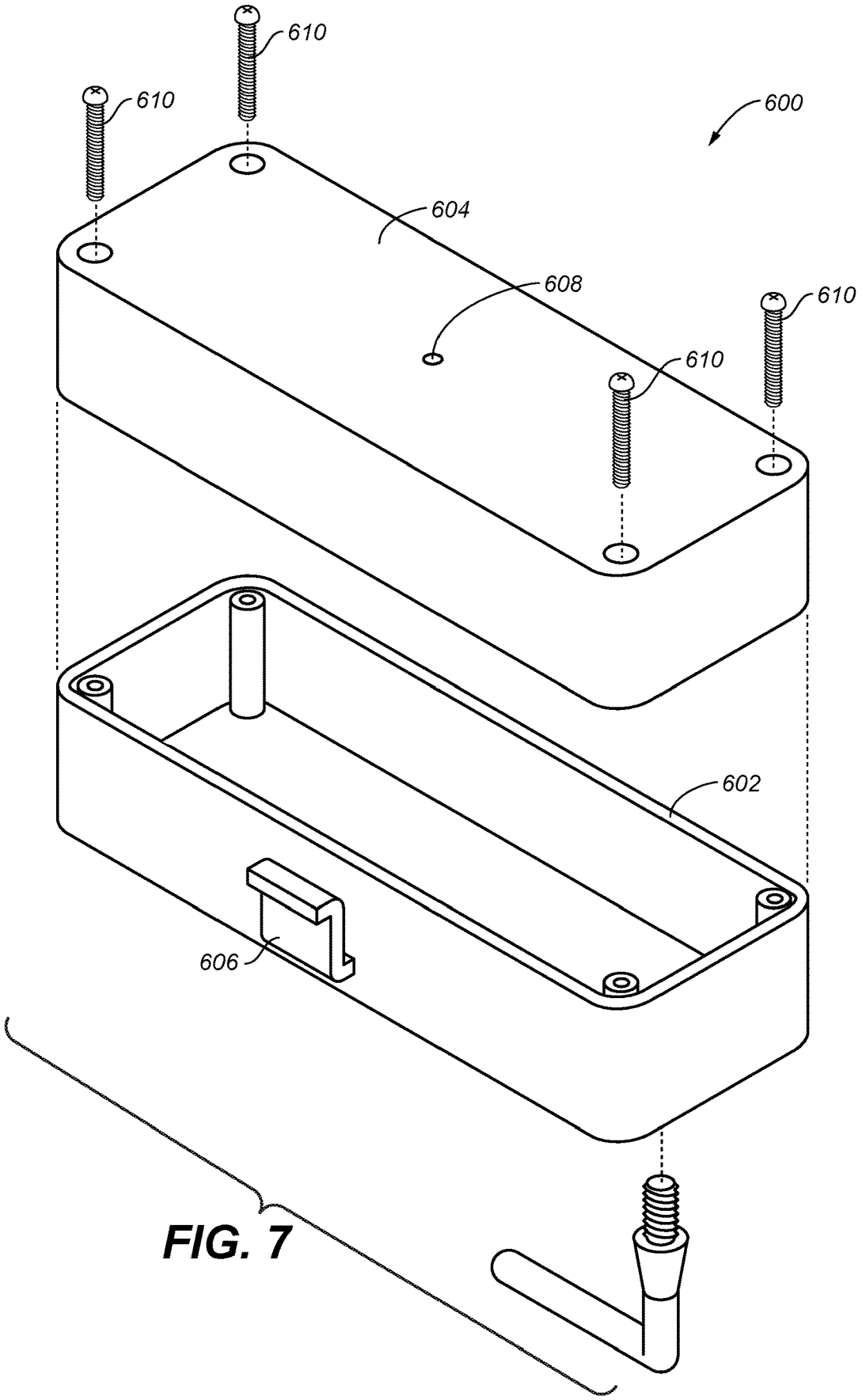
FIG. 7 is an exploded right top perspective view of communication/sensor box 600 for all embodiments of the trackable nylon pallet.

Embodiments of the nylon pallets 100, 200, 300, 400 include one locking caster 700 releasably attached to each bottom portion planar bottom side ninety-degree corner, 118, 218, 318, and 418, respectively, FIGS. 6B and 6C, by inserting an expandable caster head 702 sized to be received into and held by the open end of an upstanding nylon post with extended attachment clip 42 from the bottom portion planar bottom side, 106, 206, 306, and 406, respectively. Once each caster head 702 has been received into the open end of each upstanding nylon post with extended attachment clip 42, the caster is locked into the open end by tightening a bolt on the bottom of the caster head causing the caster head to expand against the upstanding nylon post with extended attachment clip 42 open end internal surface.

An embodiment of the nylon pallet 300 includes equal sized rectangular top and bottom portions, 304 and 302, respectively, each top and bottom portion providing two 1000 mm pallet wide side lengths 316, and two 1200 mm pallet long side lengths 314.

An embodiment of the nylon pallet 100 includes equal sized rectangular top and bottom portions, 104 and 102, respectively, each top and bottom portion providing two 600 mm pallet wide side lengths 116, and two 800 mm pallet long side lengths 114.

An embodiment of the nylon pallet 400 includes equal sized square top and bottom portions, 404 and 402, respectively, and four 1165 mm pallet side lengths.

An embodiment of the nylon pallet 200 includes equal sized square top and bottom portions, 204 and 202, respectively, and four 800 mm pallet side lengths.

All disclosed embodiments of the nylon pallets can withstand a rack able load of 2,722 kg, and a static load of 45,359 kg.

All disclosed embodiments of the nylon pallet 100, 200, 300, and 400 provide top portion bottom side beveled edges, 126, 226, 326, and 426, respectively, and bottom portion top side beveled edges 128, 228, 328, and 428, respectively, on pallet width sides 116, 216, 316, 416, respectively, and pallet length sides 114, 214, 314, and 414, respectively. These beveled edges 126, 128, 226, 228, 326, 338, 426 and 428 are equal sized and define equipment entry passages between the pallet top portions 104, 204, 304, and 404, respectively, and pallet bottom portions, 102, 202, 302, and 402, respectively, from all four pallet sides, FIGS. 4, 11, 15, and 19, without obstruction by or contact with the pallet connection and locking assembly points between the pallet bottom portion 102, 202, 302, and 402, respectively, and the pallet top portion 104, 204, 304, and 404, respectively.

For all disclosed embodiments of the nylon pallet 100, 200, 300, and 400, when each bottom portion top side 108, 208, 308, and 408, respectively, array of upstanding nylon posts connects and locks with a corresponding top portion bottom side 112, 212, 312, and 412, respectively, array of four upstanding nylon posts a low profile, high weight capacity nylon pallet 100, 200, 300, and 400, is formed, the low profile, high weight capacity nylon pallet further comprising equipment entry passages between the nylon pallet top portion 104, 204, 304, and 404, respectively, and the nylon pallet bottom portion 102, 202, 302, and 402 from all four pallet sides, and real time tracking, identification, and monitoring capabilities, FIGS. 1-20.

The disclosed embodiments of the nylon pallets 100, 200, 300, and 400, including the pallet top portions 104, 204, 304, and 404, respectively, the pallet bottom portions 102, 202, 302, and 402, respectively, upstanding nylon post open ends 36, upstanding nylon posts with extended attachment clip 42, and locking pins 54, are manufactured from injection molded nylon consisting of post-consumer nylon, post-industrial nylon, and virgin nylon, all reinforced with glass.

The disclosed communication/sensor box 600, including the box bottom 602, the box top 604, the box side clip 606 are manufactured from injection molded nylon consisting of post-consumer nylon, post-industrial nylon, and virgin nylon, all reinforced with carbon black.

We claim:

1. A nylon pallet comprising, in combination;

a) a rigid, injection molded nylon bottom portion comprising a planar bottom side and a top side, two equal length sides, two equal width sides, four ninety-degree corners, a plurality of equal sized upstanding nylon posts affixed to the bottom portion top side in four equal sized arrays of four upstanding nylon posts in the four corners of the bottom portion top side, three equal sized arrays of four upstanding nylon posts along a central axis of the bottom portion length sides with two equal sized arrays near the center portion of each length side and the third equal array centered between the two arrays in the center of the bottom portion top side, and two equal sized arrays of four upstanding nylon posts along a central axis of the bottom portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip, and wherein two equal sized arrays of four upstanding nylon posts along a central axis of the bottom portion width sides further comprise equal sized nylon frame sides between upstanding nylon posts, the frame sides orthogonally disposed to the central axis of the bottom portion width sides;

b) a rigid, injection molded nylon top portion of equal size to the bottom portion and comprising a bottom side and a planar top side, two equal length sides, two equal width sides, four ninety-degree corners, a plurality of equal sized upstanding nylon posts affixed to the top portion bottom side in four equal sized arrays of four upstanding nylon posts in the four corners of the top portion bottom side, three equal sized arrays of four upstanding nylon posts along a central axis of the top portion length sides with two equal sized arrays near the center portion of each top portion length side and the third equal array centered between the two arrays in the center of the top portion bottom side, and two equal sized arrays of four upstanding nylon posts along a central axis of the top portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip wherein the two diagonally disposed upstanding nylon posts comprising extended attachment clips for each top portion array correspond to the two diagonally upstanding post open ends on a corresponding bottom side array, and wherein two equal sized arrays of four upstanding nylon posts along a central axis of the top portion width sides further comprise equal sized nylon frame sides between upstanding nylon posts corresponding to the equal sized frame sides between upstanding nylon posts of the bottom portion, the frame sides orthogonally disposed to the central axis of the top portion width sides;

c) a nylon locking pin to secure each upstanding post with extended attachment clip to each upstanding post open end; and d) at least one container sized to be received and releasably held by the frame sides, the at least one container comprising at least one integral global positioning system, at least one integral radio frequency identification device, at least one integral temperature sensor, at least one integral sensor calibrated to detect chemicals, an integral power supply and connected wiring to power components housed in the container, and bottom portion external surface side clips sized to engage and releasably attach to the respective frame sides extending upwards from the pallet bottom portion top side;

whereby, when each bottom portion top side array of upstanding nylon posts connects with a corresponding top portion bottom side array of upstanding nylon posts a low profile, high weight capacity pallet is formed, the pallet further comprising equipment entry passages between the top and bottom portions from all four sides, and real time tracking, identification, and monitoring capabilities.

2. The nylon pallet of claim 1, further comprising at least one locking caster attached to each bottom portion planar bottom side ninety-degree corner.

3. The nylon pallet of claim 1, further comprising equal sized rectangular top and bottom portions, two 1000 mm width side lengths, and two 1200 mm length side lengths.

4. The nylon pallet of claim 1, further comprising equal sized square top and bottom portions, and four 1165 mm side lengths.

5. A nylon pallet comprising, in combination;

a) a rigid, injection molded nylon bottom portion comprising a planar bottom side and a top side, two equal length sides, two equal width sides, four ninety-degree corners, a plurality of upstanding nylon posts affixed to the bottom portion top side in an array of four upstanding nylon posts in each of the four corners of the bottom portion top side, three arrays of two upstanding nylon posts along a central axis of the bottom portion length sides with one array of two posts centered on the central axis and each other array of two posts spaced equidistant from the center so one post of each array of two posts from the center is near the length edge, and two arrays of four upstanding nylon posts along a central axis of the bottom portion width sides aligned with two of the respective four corner arrays for the width side, whereby each array of four upstanding nylon posts comprises two diagonally disposed upstanding nylon posts further comprising extended nylon attachment clips and two diagonally opposed posts comprising an open end sized to receive an attachment clip, whereby each array of two posts comprises one upstanding post further comprising an extended nylon attachment clip and one post comprising an open end sized to receive an attachment clip, and wherein the two arrays of four upstanding nylon posts on the width centerline further comprise equal sized nylon frame sides between upstanding nylon posts, the frame sides orthogonally disposed to the central axis of the bottom portion length sides;

b) a rigid, injection molded nylon top portion of equal size to the bottom portion and comprising a bottom side and a planar top side, two equal length sides, two equal width sides, four ninety-degree corners, a plurality of upstanding nylon posts affixed to the top portion bottom side in an array of four upstanding nylon posts in each of the four corners of the top portion bottom side, three arrays of two upstanding nylon posts along a central axis of the top portion length sides with one array of two posts centered on the central axis and each other array of two posts spaced equidistant from the center so one post of each array of two posts from the center is near the length edge, and two arrays of four upstanding nylon posts along a central axis of the top portion width sides aligned with two of the respective four corner arrays for the width side, whereby each array of four upstanding nylon posts comprises two diagonally disposed upstanding nylon posts further comprising extended nylon attachment clips and two diagonally opposed posts comprising an open end sized to receive an attachment clip, whereby each array of two posts comprises one upstanding post further comprising an extended nylon attachment clip and one post comprising an open end sized to receive an attachment clip, and wherein the two arrays of four upstanding nylon posts on the width centerline further comprise equal sized nylon frame sides between upstanding nylon posts, the frame sides orthogonally disposed to the central axis of the top portion length sides;

c) a nylon locking pin to secure each post attachment clip to each post open end; and d) at least one container sized to be received and releasably held by the frame sides, the at least one container comprising at least one integral global positioning system, at least one integral radio frequency identification device, at least one integral temperature sensor, and at least one integral sensor calibrated to detect chemicals, an integral power supply and connected wiring to power components housed in the container, and bottom portion external surface side clips sized to engage and releasably attach to the respective frame sides extending upwards from the pallet bottom portion top side;

whereby, when each bottom portion top side array of four upstanding nylon posts connects with a corresponding top portion bottom side array of four upstanding nylon posts a low profile, high weight capacity pallet is formed, the pallet further comprising equipment entry passages between the top and bottom portions from all four sides, and real time tracking, identification, and monitoring capabilities.

6. The nylon pallet of claim 5, further comprising at least one locking caster attached to each bottom portion planar bottom side ninety-degree corner.

7. The nylon pallet of claim 5, further comprising equal sized square top and bottom portions, and four 800 mm side lengths.

8. A nylon pallet comprising, in combination;

a) a rigid, injection molded nylon bottom portion comprising a planar bottom side and a top side, two equal length sides, two equal width sides, four ninety-degree corners, a plurality of equal sized upstanding nylon posts affixed to the bottom portion top side in four equal sized arrays of four upstanding nylon posts in the four corners of the bottom portion top side, two equal sized arrays of two upstanding nylon posts along a central axis of a pair of bottom portion length sides each equal sized array of two posts near the center portion of each length side, whereby each equal sized array of four upstanding nylon posts comprises two diagonally disposed upstanding nylon posts further comprising extended nylon attachment clips and two diagonally opposed posts comprising an open end sized to receive an attachment clip, whereby each array of two posts comprises one upstanding post further comprising an extended nylon attachment clip and one post comprising an open end sized to receive an attachment clip, and wherein two equal sized arrays of four upstanding nylon posts on diagonal corners further comprise equal sized nylon frame sides between upstanding nylon posts, the frame sides orthogonally disposed to the central axis of the bottom portion length sides;

b) a rigid, injection molded nylon top portion of equal size to the bottom portion and comprising a bottom side and a planar top side, two equal length sides, two equal width sides, four ninety-degree corners, a plurality of equal sized upstanding nylon posts affixed to the top portion bottom side in four equal sized arrays of four upstanding nylon posts in the four corners of the top portion bottom side, whereby each equal sized array of four upstanding nylon posts comprises two diagonally disposed upstanding nylon posts further comprising extended nylon attachment clips and two diagonally opposed posts comprising an open end sized to receive an attachment clip, whereby each array of two posts comprises one upstanding post further comprising an extended nylon attachment clip and one post comprising an open end sized to receive an attachment clip, and wherein two equal sized arrays of four upstanding nylon posts on diagonal corners further comprise equal sized nylon frame sides between upstanding nylon posts, the frame sides orthogonally disposed to the central axis of the bottom portion length sides, whereby each equal sized array of four upstanding nylon posts comprises two diagonally disposed upstanding nylon posts further comprising extended nylon attachment clips and two diagonally opposed posts comprising an open end sized to receive an attachment clip wherein the two diagonally disposed upstanding nylon posts comprising extended attachment clips for each top portion array correspond to the two diagonally upstanding post open ends on a corresponding bottom side array;

c) a nylon locking pin to secure each post attachment clip to each post open end; and d) at least one container sized to be received and releasably held by the frame sides, the at least one container comprising at least one integral global positioning system, at least one integral radio frequency identification device, at least one integral temperature sensor, and at least one integral sensor calibrated to detect chemicals, an integral power supply and connected wiring to power components housed in the container, and bottom portion external surface side clips sized to engage and releasably attach to the respective frame sides extending upwards from the pallet bottom portion top side;

whereby, when each bottom portion top side array of four upstanding nylon posts connects with a corresponding top portion bottom side array of four upstanding nylon posts a low profile, high weight capacity pallet is formed, the pallet further comprising equipment entry passages between the top and bottom portions from all four sides, and real time tracking, identification, and monitoring capabilities.

9. The nylon pallet of claim 8, further comprising at least one locking caster attached to each bottom portion planar bottom side ninety-degree corner.

10. The nylon pallet of claim 8, further comprising equal sized rectangular top and bottom portions, two 600 mm width side lengths, and two 800 mm length side lengths.

* * * * *